US006703990B2

(12) United States Patent
Tokunaga et al.

(10) Patent No.: US 6,703,990 B2
(45) Date of Patent: Mar. 9, 2004

(54) METHOD FOR DRIVING A PLASMA DISPLAY PANEL

(75) Inventors: Tsutomu Tokunaga, Yamanashi (JP); Hideto Nakamura, Yamanashi (JP)

(73) Assignee: Pioneer Corporation, Tokyo (JP)

( * ) Notice: Subject to any disclaimer, the term of this patent is extended or adjusted under 35 U.S.C. 154(b) by 356 days.

(21) Appl. No.: 09/864,091

(22) Filed: May 24, 2001

(65) Prior Publication Data

US 2002/0054002 A1 May 9, 2002

(30) Foreign Application Priority Data

May 25, 2000 (JP) ..... 2000-154867

(51) Int. Cl.[7] ..... G09G 3/28
(52) U.S. Cl. ..... 345/60; 315/169.4
(58) Field of Search ..... 345/60, 61, 62, 345/63, 68, 55, 74.1; 315/111.21, 169.1, 169.2, 169.3, 169.4

(56) References Cited

U.S. PATENT DOCUMENTS

| | | | | | |
|---|---|---|---|---|---|
| 5,854,540 | A | * | 12/1998 | Matsumoto et al. | 315/169.1 |
| 6,087,779 | A | * | 7/2000 | Sakamoto et al. | 315/169.1 |
| 6,369,782 | B2 | * | 4/2002 | Shigeta | 345/63 |
| 6,414,658 | B1 | * | 7/2002 | Tokunaga | 345/63 |
| 6,473,061 | B1 | * | 10/2002 | Lim et al. | 345/60 |
| 2002/0008680 | A1 | * | 1/2002 | Hashimoto et al. | 345/63 |

* cited by examiner

*Primary Examiner*—Richard Hjerpe
*Assistant Examiner*—Ronald Laneau
(74) *Attorney, Agent, or Firm*—Sughrue Mion, PLLC

(57) ABSTRACT

A method for driving a plasma display panel allows displaying an image of high quality having a large number of tones without causing a discharge cell to discharge erroneously. The width of a first sustaining pulse to be first supplied during each of the light emission sustaining processes to be executed during the display period of one field is set wider than that of the subsequent sustaining pulses, and the width of said first sustaining pulse is narrowed in accordance with the frequency of the light emission sustaining discharges occurring immediately before.

7 Claims, 21 Drawing Sheets

FIG. 16

| 2ND DATA CONVERSION CIRCUIT 34 CONVERSION TABLE | | | | | | | | | LIGHT EMISSION PATTERN | | | | | | | | BRIGHTNESS |
|---|---|---|---|---|---|---|---|---|---|---|---|---|---|---|---|---|---|
| PDs | GD 1 | 2 | 3 | 4 | 5 | 6 | 7 | 8 | SF 1 | SF 2 | SF 3 | SF 4 | SF 5 | SF 6 | SF 7 | SF 8 | |
| 0000 | 1 | 1 | 1 | 1 | 1 | 1 | 1 | 1 | ● | ● | ● | ● | ● | ● | ● | ● | 0 |
| 0001 | 0 | 1 | 1 | 1 | 1 | 1 | 1 | 1 | ○ | ● | ● | ● | ● | ● | ● | ● | 1 |
| 0010 | 0 | 0 | 1 | 1 | 1 | 1 | 1 | 1 | ○ | ○ | ● | ● | ● | ● | ● | ● | 7 |
| 0011 | 0 | 0 | 0 | 1 | 1 | 1 | 1 | 1 | ○ | ○ | ○ | ● | ● | ● | ● | ● | 23 |
| 0100 | 0 | 0 | 0 | 0 | 1 | 1 | 1 | 1 | ○ | ○ | ○ | ○ | ● | ● | ● | ● | 47 |
| 0101 | 0 | 0 | 0 | 0 | 0 | 1 | 1 | 1 | ○ | ○ | ○ | ○ | ○ | ● | ● | ● | 82 |
| 0110 | 0 | 0 | 0 | 0 | 0 | 0 | 1 | 1 | ○ | ○ | ○ | ○ | ○ | ○ | ● | ● | 128 |
| 0111 | 0 | 0 | 0 | 0 | 0 | 0 | 0 | 1 | ○ | ○ | ○ | ○ | ○ | ○ | ○ | ● | 185 |
| 1000 | 0 | 0 | 0 | 0 | 0 | 0 | 0 | 0 | ○ | ○ | ○ | ○ | ○ | ○ | ○ | ○ | 255 |

BLACK CIRCLE : SELECTIVE ERASING DISCHARGE
WHITE CIRCLE : LIGHT EMISSION

FIG. 20

| 2ND DATA CONVERSION CIRCUIT 34 CONVERSION TABLE | | | | | | | | | LIGHT EMISSION PATTERN | | | | | | | | BRIGHTNESS |
|---|---|---|---|---|---|---|---|---|---|---|---|---|---|---|---|---|---|
| PDs | GD 1 | 2 | 3 | 4 | 5 | 6 | 7 | 8 | SF 1 | SF 2 | SF 3 | SF 4 | SF 5 | SF 6 | SF 7 | SF 8 | |
| 0000 | 1 | 0 | 0 | 0 | 0 | 0 | 0 | 0 | ● | | | | | | | | 0 |
| 0001 | 0 | 1 | 0 | 0 | 0 | 0 | 0 | 0 | ○ | ● | | | | | | | 1 |
| 0010 | 0 | 0 | 1 | 0 | 0 | 0 | 0 | 0 | ○ | ○ | ● | | | | | | 7 |
| 0011 | 0 | 0 | 0 | 1 | 0 | 0 | 0 | 0 | ○ | ○ | ○ | ● | | | | | 23 |
| 0100 | 0 | 0 | 0 | 0 | 1 | 0 | 0 | 0 | ○ | ○ | ○ | ○ | ● | | | | 47 |
| 0101 | 0 | 0 | 0 | 0 | 0 | 1 | 0 | 0 | ○ | ○ | ○ | ○ | ○ | ● | | | 82 |
| 0110 | 0 | 0 | 0 | 0 | 0 | 0 | 1 | 0 | ○ | ○ | ○ | ○ | ○ | ○ | ● | | 128 |
| 0111 | 0 | 0 | 0 | 0 | 0 | 0 | 0 | 1 | ○ | ○ | ○ | ○ | ○ | ○ | ○ | ● | 185 |
| 1000 | 0 | 0 | 0 | 0 | 0 | 0 | 0 | 0 | ○ | ○ | ○ | ○ | ○ | ○ | ○ | ○ | 255 |

BLACK CIRCLE : SELECTIVE ERASING DISCHARGE
WHITE CIRCLE : LIGHT EMISSION

FIG. 21

| 2ND DATA CONVERSION CIRCUIT 34 CONVERSION TABLE | | | | | | | | | LIGHT EMISSION PATTERN | | | | | | | | BRIGHTNESS |
|---|---|---|---|---|---|---|---|---|---|---|---|---|---|---|---|---|---|
| PDs | GD | | | | | | | | SF | SF | SF | SF | SF | SF | SF | SF | |
| | 1 | 2 | 3 | 4 | 5 | 6 | 7 | 8 | 1 | 2 | 3 | 4 | 5 | 6 | 7 | 8 | |
| 0000 | 1 | 1 | * | * | * | * | * | * | ● | ● | △ | △ | △ | △ | △ | △ | 0 |
| 0001 | 0 | 1 | 1 | * | * | * | * | * | ○ | ● | ● | △ | △ | △ | △ | △ | 1 |
| 0010 | 0 | 0 | 1 | 1 | * | * | * | * | ○ | ○ | ● | ● | △ | △ | △ | △ | 7 |
| 0011 | 0 | 0 | 0 | 1 | 1 | * | * | * | ○ | ○ | ○ | ● | ● | △ | △ | △ | 23 |
| 0100 | 0 | 0 | 0 | 0 | 1 | 1 | * | * | ○ | ○ | ○ | ○ | ● | ● | △ | △ | 47 |
| 0101 | 0 | 0 | 0 | 0 | 0 | 1 | 1 | * | ○ | ○ | ○ | ○ | ○ | ● | ● | △ | 82 |
| 0110 | 0 | 0 | 0 | 0 | 0 | 0 | 1 | 1 | ○ | ○ | ○ | ○ | ○ | ○ | ● | ● | 128 |
| 0111 | 0 | 0 | 0 | 0 | 0 | 0 | 0 | 1 | ○ | ○ | ○ | ○ | ○ | ○ | ○ | ● | 185 |
| 1000 | 0 | 0 | 0 | 0 | 0 | 0 | 0 | 0 | ○ | ○ | ○ | ○ | ○ | ○ | ○ | ○ | 255 |

* : "1" OR "0"

BLACK CIRCLE : SELECTIVE ERASING DISCHARGE
WHITE CIRCLE : LIGHT EMISSION $Ta_2 > Ta_3 > Ta_4 > Ta_5 > Ta_6 > Ta_7 > Ta_8 > Tb$ $Tc_2 > Tc_3 > Tc_4 > Tc_5 > Tc_6 > Tc_7$

METHOD FOR DRIVING A PLASMA DISPLAY PANEL

BACKGROUND OF THE INVENTION

1. Field of the Invention

The present invention relates to a method for driving a plasma display panel.

2. Description of the Related Background Art

Recently, with the increase in the screen size of display apparatuses, thin-shape display apparatuses have become available, and various kinds of thin-shape display devices have been put into practical use. Amongst such thin-shape display devices, much attention is now being paid to AC (alternating current) type of plasma display panels.

FIG. 1 is a schematic diagram of a plasma display apparatus comprising such a plasma display panel and a driver to drive this display panel.

In FIG. 1, the plasma display panel PDP 10 comprises m column electrodes $D_1$–$D_m$ as data electrodes, and n row electrodes $X_1$–$X_n$ and n row electrodes $Y_1$–$Y_n$ which intersect each of the column electrodes. One pair of $X_i$ ($1 \leqq i \leqq n$) and $Y_i$ ($1 \leqq i \leqq n$) of the row electrodes $X_1$–$X_n$ and $Y_1$–$Y_n$ forms one display line of the PDP 10. The column electrodes D and the row electrodes X and Y are arranged face each other with a discharge space containing discharge gas therebetween. A discharge cell corresponding to a picture element is formed at the intersection of each row electrode and each column electrode with the discharge space between them.

Each discharge cell emits light by the discharge effect, so each cell can have only two states, a "light emitting" state or a "non-light emitting" state. That is, each discharge cell exhibits only two gradations, minimum brightness (non-light emitting state) and maximum brightness (light emitting state).

Therefore, the driver 100 performs gradation drive by using the subfield method in order to display brightness of half tone corresponding to a video signal supplied to the PDP 10. In the subfield method, an input video signal is converted, for example, into 4-bit picture element data corresponding to each picture element. The display period of one field is divided into four subfields SF1–SF4 so that each subfield corresponds to each bit digit of said picture element data, as is shown in FIG. 2. As indicated in FIG. 2, a light emitting frequency (or light emitting period) corresponding to the weight of the subfield is allocated to each subfield.

FIG. 3 shows various kinds of driving pulses to be supplied to the row electrodes and the column electrodes of the PDP 10 in each subfield shown in FIG. 2, and the pulse supply timing.

As shown in FIG. 3, the driver 100 supplies negative reset pulses RPx to the row electrodes X1–Xn, and positive reset pulses RPy to the row electrodes Y1–Yn. In response to the supply of these reset pulses RPX and RPY, all the discharge cells of the PDP 10 are reset and discharged and a predetermined wall charge is uniformly formed in each discharge cell. Thus, all the discharge cells in the PDP 10 are initialized to the "non-light emitting cell" state (simultaneous reset process Rc).

Next, the driver 100 separates each bit digit of said 4-bit picture element data into the subfields SF1–SF4, and generates picture element data pulses having a pulse voltage corresponding to the logical level of said bit. For example, during the picture element data write process Wc for the subfield SF1, the driver 100 generates picture element pulses having a pulse voltage corresponding to the logical level of the first bit of said picture element data. In this case, the driver 100 generates picture element data pulses of high voltage when the logical level of the first bit is "1" and it generates picture element data pulses of low voltage (O volt) when said logical level is "0". In addition, the driver 100 supplies said picture element data pulses to the column electrodes $D_1$–$D_m$ sequentially as picture element data pulse groups $DP_1$–$DP_n$ for one display line corresponding to one of the first-nth display lines. In addition, the driver 100 generates negative scanning pulses SP as shown in FIG. 3 in synchronization with the supply timing of each picture element data pulse group DP, and supplies the scanning pulses SP to the row electrodes $Y_1$–$Y_n$ sequentially. In this case, only a discharge cell at the intersection of a display line to which said scanning pulses SP were supplied and a "column" to which the picture element data pulses of high voltage were supplied discharges (selective erasing discharge), and the wall charge in that discharge cell disappears. Thus, the discharge cell which was initialized to a "light emission cell" state during said simultaneous reset process Rc is shifted to a "non-light emission cell state. On the other hand, a discharge cell to which the scanning pulses SP were supplied and at the same time the low voltage picture element data pulses were also supplied does not generate the above-mentioned selective erasing discharge. Thus, this discharge cell is sustained at the state initialized during said simultaneous reset process Rc, namely, at the "light emission cell" state. Therefore, each discharge cell of the PDP 10 is set to the "light emission cell" state or the "non-light emission cell" state in accordance with the picture element data corresponding to the input video signal (picture element data write process Wc).

Next, the driver 100 supplies sustaining pulses $IP_X$ and $IP_Y$ as shown in FIG. 3 to the row electrodes $X_1$–$X_n$ and the row electrodes $Y_1$–$Y_n$ alternately and repeatedly. When the supply frequency during the light emission sustaining process Ic of the subfield SF-1 is "1", the supply frequency (or period) of the sustaining pulses $IP_X$ and $IP_Y$ during the sustaining process Ic of each subfield SF1–SF4 shown in FIG. 2 is as follows.

SF1:1
SF2:2
SF3:4
SF4:8

In this case, only a discharge cell in which a wall charge remains in its discharge space, namely, only a "light emission cell", discharges (discharge for sustaining light emission cell state) each time such sustaining pulses $IP_X$ and $IP_y$ are supplied to such a cell. That is, only a discharge cell which did not produce a selective erasing discharge during said picture element data write process Wc emits light due to said sustaining discharge repeatedly by a frequency allocated to each subfield as described above, and sustains its light emitting state (light emission sustaining process Ic).

Finally, the driver 100 supplies erasing pulses EP shown in FIG. 3 to the row electrodes $Y_1$–$Y_n$ simultaneously. Because of the supply of such erasing pulses EP, erasing discharge takes place in all the discharge cells of the PDP 10, and the wall charge remaining in these discharge cells disappears (erasing process E).

A series of such processes as said simultaneous reset process Rc, picture element data write process Wc, light emission sustaining process Ic and erasing process E are executed for each of the subfields SF1–SF4 shown in FIG. 2. By such driving, the light due to the sustaining discharge is emitted by a frequency corresponding to the brightness level of the input video signal throughout the display period of one field. In this case, an intermediate tone corresponding to the light emission frequency is visible. Therefore, as is shown in FIG. 2, by tone-driving based on the four subfields SF1–SF4, intermediate tones "0" to "15" can be displayed in 16 stages (16 tones).

If the number of divided subfields is increased, the number of tones which can be represented is also increased, so an image of higher quality can be displayed. For example, narrowing the width of each of the sustaining pulses IP which are supplied repeatedly as is shown in FIG. 3 decreases the time required for each light emission sustaining process Ic, so the number of subfields can be increased by using the extra time made available.

However, narrowing the width of the sustaining pulses IP may result in erroneous discharge, especially when the amount of charged particles remaining in the discharge space of each discharge cell is small. Therefore, it is impossible to narrow the pulse width beyond a certain limit.

SUMMARY OF THE INVENTION

An object of the present invention is to provide a method for driving a plasma display panel which can display an image of high quality with many tone stages without causing discharge cells to discharge erroneously.

A method for driving a plasma display panel according to the present invention is a method for driving a plasma display panel by driving the tone of said plasma display panel in which each discharge cell is formed at each intersection of a plurality of row electrodes corresponding to a display line and a plurality of column electrodes intersecting with said row electrodes in accordance with a video signal, comprising: in each of a plurality of subfields constituting a display period of one field of said video signal, a picture element data write process for supplying scanning pulses to each of said row electrodes sequentially, which generate selective discharge for setting each of said discharge cells to the light emission cell state or non-light emission cell state in accordance with the picture element data corresponding to said video signal; and a light emission sustaining process for supplying sustaining pulses which generate sustaining discharge only in said discharge cells in said light emission cell state to each of said row electrodes by a frequency corresponding to the weight of each of said subfields; wherein the width of the first sustaining pulse of said sustaining pulses to be supplied first during said light emission sustaining process is set wider than that of the subsequent sustaining pulses, and the width of said first sustaining pulse is narrowed in accordance with the frequency of said sustaining discharge occurring immediately before the supply of said first sustaining pulse during the display period of one field.

BRIEF DESCRIPTION OF THE DRAWINGS

FIG. 16 is a diagram showing an example of the conversion table and light emission pattern of a second data conversion circuit 34;

FIG. 20 is a diagram showing another example of the conversion table and the light emission pattern of the second data conversion circuit 34;

FIG. 21 is a diagram showing another example of the conversion table and the light emission pattern of the second data conversion circuit 34.

DETAILED DESCRIPTION OF THE PREFERRED EMBODIMENT

The embodiments of the present invention will be described below with reference to the accompanying drawings.

Figure 1:
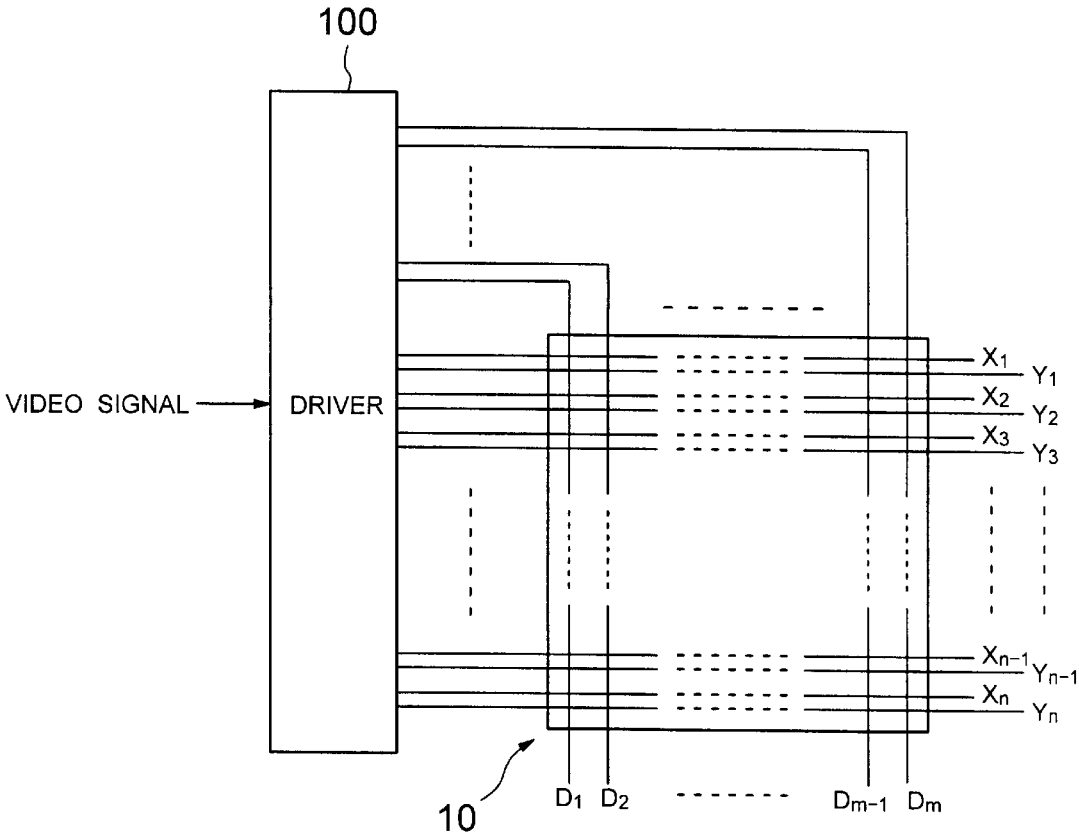
FIG. 1 (PRIOR ART)
FIG. 1 shows a schematic configuration of a plasma display apparatus.
Figure 2:
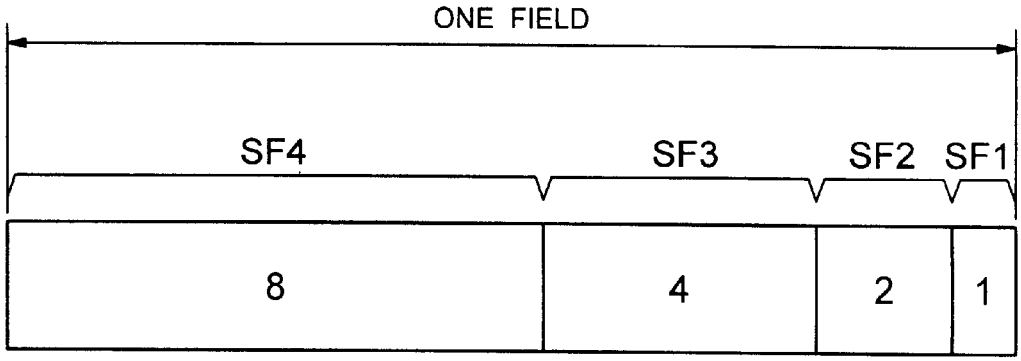
FIG. 2 (PRIOR ART)
FIG. 2 is a diagram showing an example of a light emission driving format.
Figure 3:
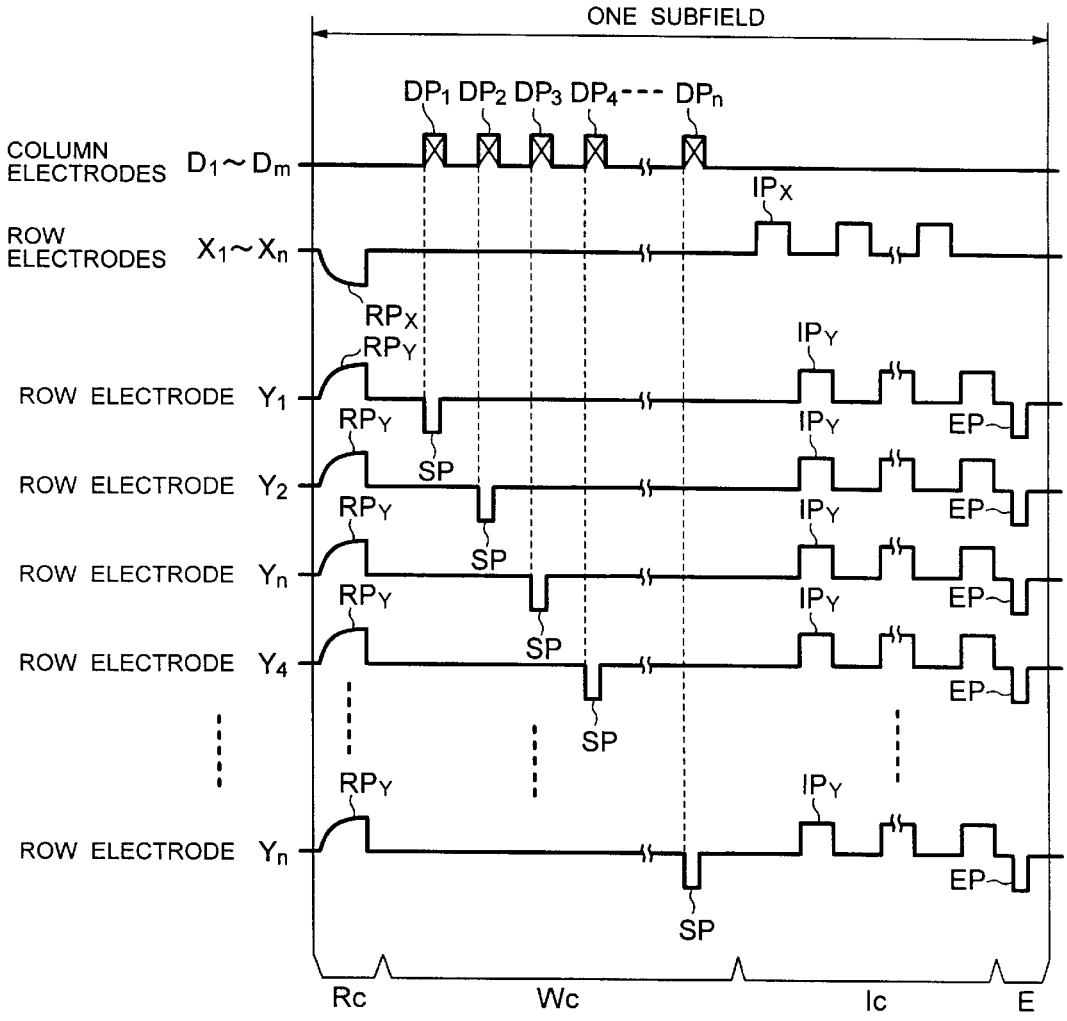
FIG. 3 (PRIOR ART)
FIG. 3 is a diagram showing the supply timing of driving pulses to be supplied to the column electrodes and row electrodes of the PDP 10 in one subfield.
Figure 4:
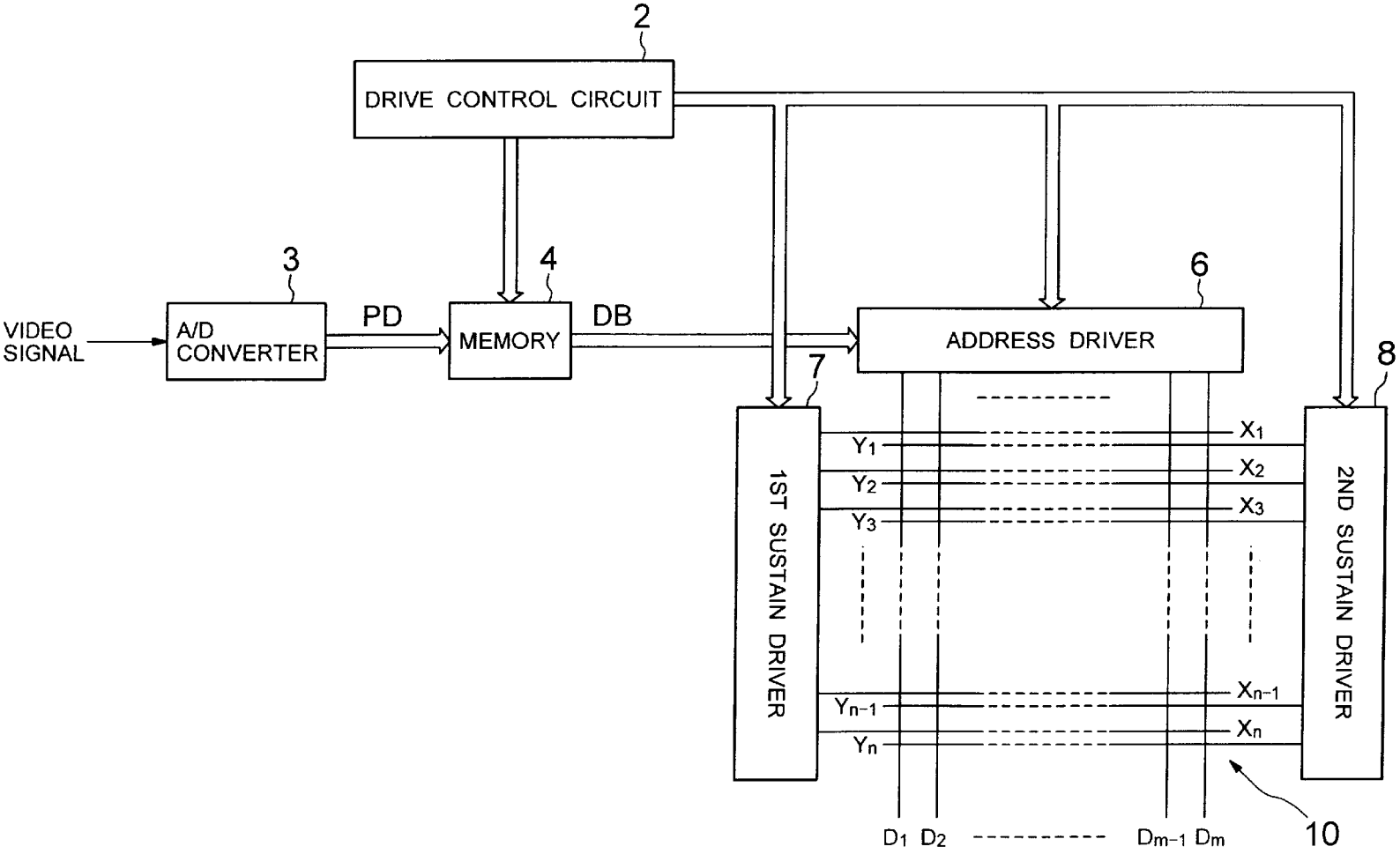
FIG. 4 is a diagram showing a schematic configuration of a plasma display apparatus for driving a plasma display panel in accordance with the driving method of the present invention.

FIG. 4 is a diagram showing the schematic configuration of a plasma display apparatus comprising a driver for driving a plasma display panel in accordance with the driving method of the present invention.

In FIG. 4, the plasma display panel PDP 10 comprises m column electrodes $D_1$–$D_m$, and n row electrodes $X_1$–$X_n$ and $Y_1$–$Y_n$ which intersect each of these column electrodes. Each of the row electrodes $X_1$–$X_n$ and $Y_1$–$Y_n$ form the first display line to the n-th display line in the PDP 10 as a pair of $X_i$ ($1 \leqq i \leqq n$) and $Y_i$ ($1 \leqq i \leqq n$). A discharge space filled with discharge gas is formed between the column electrode D and the row electrodes X and Y. It is so configured that a discharge cell corresponding to a picture element is formed at the intersection of each row electrode pair and each column electrode containing said discharge space.

Figure 5:
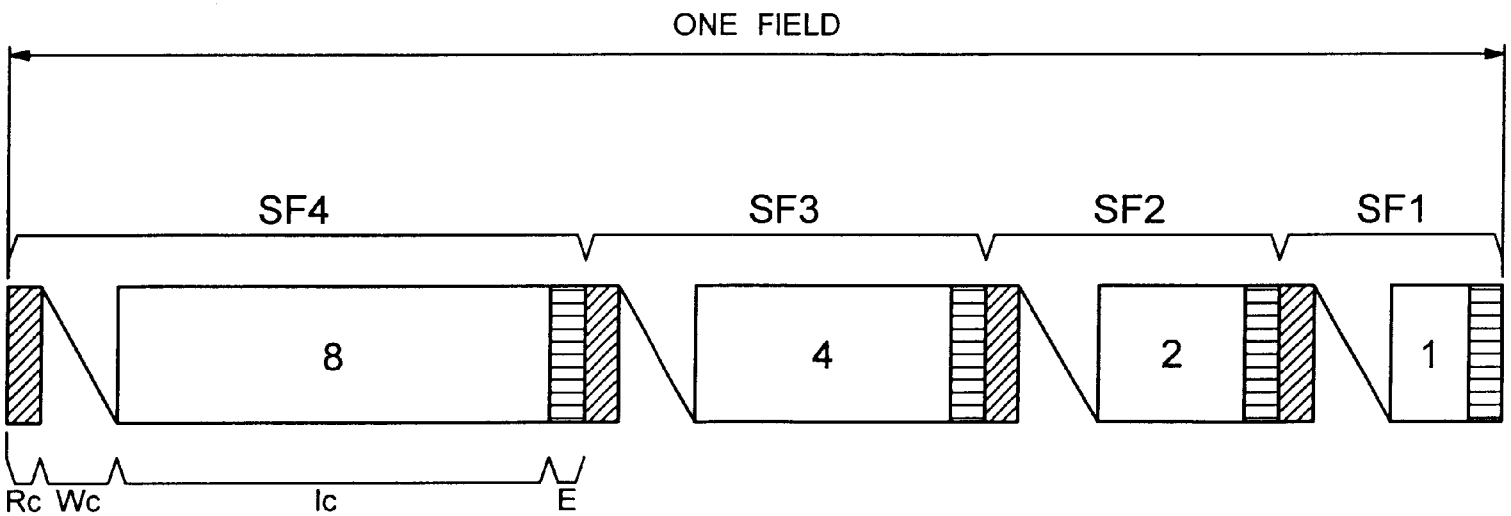
FIG. 5 is a diagram showing an example of a light emission driving format used in a drive control circuit 2.

The driver comprising a drive control circuit 2, an A/D converter 3, a memory 4, address driver 6, a first sustain driver 7 and a second sustain driver 8 drives the tone of said PDP 10 in accordance with the light emission driving format shown in FIG. 5. In the light emission driving format shown in FIG. 5, the display period of one field is divided into four subfields SF1–SF4.

The A/D converter 3 in the driver samples an input video signal, converts the sampled signal into 4-bit picture element data PD for each picture element, and sends said PD to the memory 4.

The picture element data PD supplied from the A/D converter 3 is sequentially written in the memory 4 in accordance with a write signal coming from the drive control circuit 2. Each time the writing of picture element data PD of one screen is completed, the memory 4 performs a read operation described below. Said picture element data PD for one screen contains (n×m) picture element data PD including picture element data $PD_{11}$ corresponding to the picture element of the first row and the first column through picture element data $D_{nm}$ corresponding to the picture element of the n-th row and the m-th column.

First, the fourth bit, which is the most significant bit, of each picture element data $PD_{11}$–$PD_{nm}$ in the memory 4 are assumed as picture element driving data bit $DB4_{11}$–$DB4_{nm}$. The memory 4 reads these bits by one display line at a time, and sends them to the address driver 6. Next, the third bit of each of the picture element data $PD_{11}$–$PD_{nm}$ in the memory 4 are assumed as picture element driving data bit $DB3_{11}$–$DB3_{nm}$. Thus the memory 4 reads these bits by one display line at a time, and sends them to the address driver 6. Next, the second bit of each of the picture element data $PD_{11}$–$PD_{nm}$ in the memory 4 are assumed as picture element driving data bit $DB2_{11}$–$DB2_{nm}$. Thus the memory 4 reads these bits by one display line at a time, and sends them to the address driver 6. Next, the first bit which is the least significant bit, of each of the picture element data $PD_{11}$–$PD_{nm}$ in the memory 4 are assumed as picture element driving data bit $DB1_{11}$–$DB_{nm}$. Thus the memory 4 reads these bits by one display line at a time, and sends them to the address driver 6.

The memory 4 matches each of said picture element driving data bits DB4–DB1 to the subfields SF4–SF1 shown in FIG. 5 respectively, and reads such DB4–DB1 sequentially at the timing of each subfield.

The drive control circuit 2 generates various kinds of timing signals for driving the tone of the PDP 10 in accordance with the light emission driving format shown in FIG. 5, and sends such timing signals to the address driver 6, the first tone sustain driver 7 and the second sustain driver 8.

Figure 6:
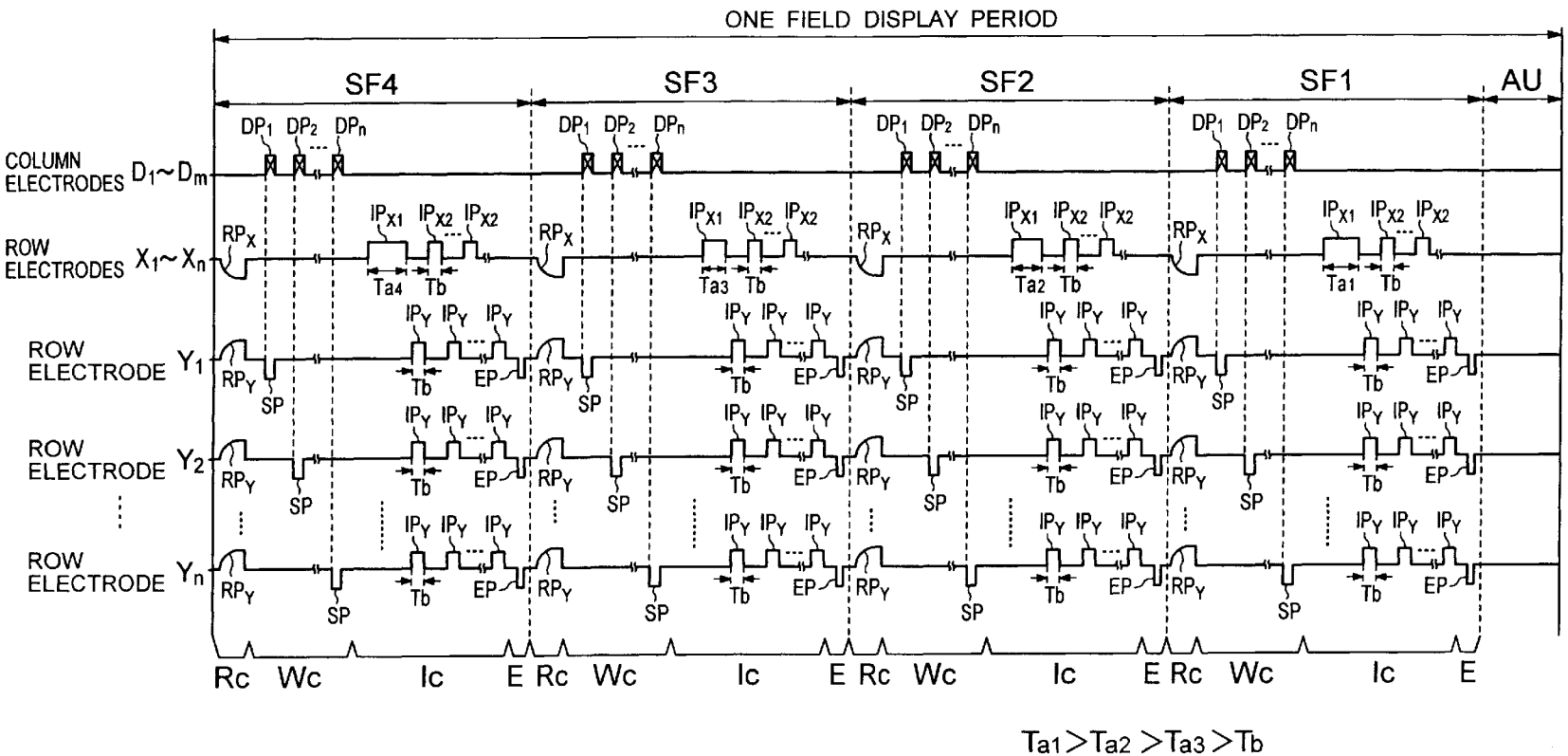
FIG. 6 is a diagram showing various kinds of driving pulses to be supplied to the column electrodes and the row electrodes of PDP 10 in accordance with the light emission driving format shown in FIG. 5 and their supply timing.

FIG. 6 is a diagram showing various kinds of driving pulses which are supplied to the PDP 10 by the address driver 6, the first sustain driver 7 and the second sustain driver 8 respectively, and their supply timing.

In FIG. 6, during the simultaneous reset process Rc which is executed at the head part of each subfield, the first sustain driver 7 generates negative reset pulses $RP_x$ and supplies them to the row electrodes $X_1$–$X_n$. In addition, simultaneously with the generation of such reset pulses $RP_x$, the second sustain driver 8 generates positive reset pulses $RP_y$ and sends them to the row electrodes $Y_1$ to $Y_n$. In response to the simultaneous supply of the reset pulses $RP_x$ and $RP_y$, the reset discharge takes place in all the discharge cells of the PDP 10, and a wall charge is formed in each discharge cell. By this process, all the discharge cells are initialized to a "light emission cell" state.

Next, during the picture element data write process Wc, the address driver 6 generates picture element data pulses having a pulse voltage corresponding to the picture element driving data bit DB sent from the memory 4. That is, in subfield SF4, the memory 4 sends picture element driving data bit DB4, so the address driver 6 generates picture element data pulses having a pulse voltage corresponding to the logical level of said picture element driving data bit DB4. In subfield SF3, picture element driving data bit DB3 is sent from the memory 4, so the address driver 6 generates picture element data pulses having a pulse voltage corresponding to the logical level of said picture element driving data bit DB3. In subfield SF2, picture element driving data bit DB2 is sent from the memory 4, so the address driver 6 generates picture element data pulses having a pulse voltage corresponding to the logical level of said picture element driving data bit DB2. Finally, in subfield SF1, picture element driving data bit DB1 is sent from the memory 4, so the address driver 6 generates picture element data pulses having a pulse voltage corresponding to the logical level of said picture element driving data bit DB1. In this case, the address driver 6 generates picture element data pulses of high voltage when the logical level of said picture element driving data bit DB is "1" and generates picture element data pulses of low voltage (0 volt) when the logical level is "0". The address driver 6 then groups the picture element data pulses generated in the described manner into picture element data pulse groups $DP_1$–$DP_n$ for each display line, and supplies said $DP_1$–$DP_n$ to the column electrodes $D_1$–$D_m$ sequentially, as shown in FIG. 6.

In addition, during the picture element data write process Wc, the second sustain driver 8 generates negative scanning pulses SP at the same timing as the supply timing of each of said picture element data pulse groups $DP_1$–$DP_n$, and supplies said pulses SP sequentially to the row electrodes $Y_1$–$Y_n$, as shown in FIG. 6. In this case, only a discharge cell at the intersection of a display line to which the scanning pulses SP were supplied and a "column" to which high voltage picture element data pulses were supplied causes a discharge (selective erasing discharge). By such selective erasing discharge, the wall charge formed in the discharge cell disappears. Thus, such discharge cell is shifted to a "non-light emission cell" state. On the other hand, a discharge cell to which the scanning pulses SP were supplied and to which low voltage picture element data pulses were also supplied simultaneously does not generate the above-mentioned selective erasing discharge. Thus, this discharge cell is sustained at the state initialized during said simultaneous reset process Rc, namely, at the "light emission cell" state.

That is, each discharge cell is set to either a "light emission cell" state or a "non-light emission cell" state in accordance with the picture element data corresponding to an input video signal during the picture element data write process Wc, and what is called picture element data write is performed.

Next, during the light emission sustaining process Ic in each subfield, the first sustain driver 7 and the second sustain driver 8 respectively supply positive sustaining pulses $IP_X$ and $IP_Y$ to the row electrodes $X_1$–$X_n$ and $Y_1$–$Y_n$ alternately, as shown in FIG. 6. In this case, when the supply frequency during the light emission sustaining process Ic in the subfield SF1 is "1", the supply frequency (or period) of sustaining pulses IP to be supplied repeatedly during the light emission sustaining process Ic of each subfield SF1–SF4 is shown below.

SF1: 1

SF2: 2

SF3: 4

SF4: 8

By such operation, only a discharge cell at which a wall charge remains, namely, only a discharge cell at a "light emission cell" state, generates a sustaining discharge each time said sustaining pulses $IP_X$ and $IP_Y$ are supplied to said discharge cell, and sustains its light emission state due to the sustaining discharge by said frequency.

During the erasing process E, which is performed at the end of each subfield, the second sustain driver 8 supplies erasing pulses EP shown in FIG. 6 to the row electrodes $Y_1$–$Y_n$. Through such an operation, erasing discharge takes place in all the discharge cells, and all the wall charge remaining in each discharge cell disappears.

Figure 7:
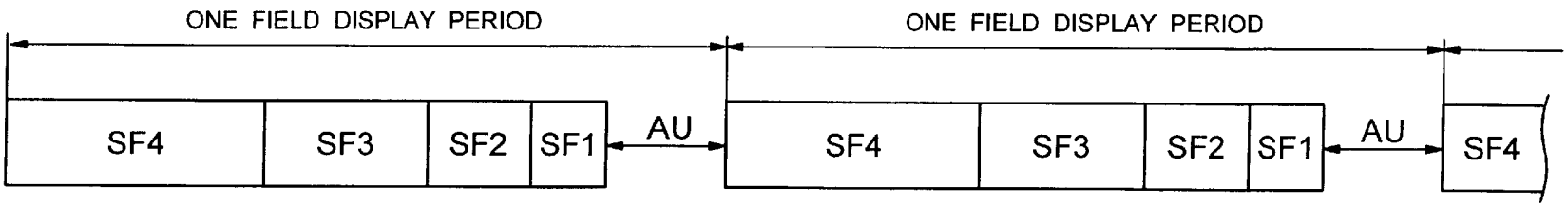
FIG. 7 is a diagram showing the timing of the subfield SF1, the preliminary period AU, and the subfield SF4.

Thus, the driver of the plasma display apparatus executes a series of such processes as said simultaneous reset process Rc, picture element data write process Wc, light emission sustaining process Ic, and erasing process E in each subfield, as shown in FIG. 6. In addition, said driver executes the operation in the display period of one field shown in FIG. 6 repeatedly, as shown in FIG. 7.

In this case, according to the present invention, the pulse width of the sustaining pulses to be supplied first during each light emission sustaining process Ic is set wider than the width of the sustaining pulses to be supplied subsequently.

For example, as shown in FIG. 6, the pulse width $T_a$ of the first sustaining pulses $IP_{X1}$ to be supplied first during the light emission sustaining process Ic is set wider than the pulse width $T_b$ of the sustaining pulses $IP_{X2}$ to be supplied subsequently. Thereby, it becomes possible to generate a normal sustaining discharge even though the amount of charged particles remaining in each discharge cell is too small immediately before each light emission sustaining process Ic. Besides, because many charged particles are formed in each discharge cell due to the sustaining discharge generated by said first sustaining pulses $IP_{X1}$, it is possible to generate a normal sustaining discharge even though the pulse width of the sustaining pulses to be supplied subsequently, namely, the pulse width $T_b$ of sustaining pulses $IP_{X2}$, is a narrow pulse width. Therefore, the time required for each light emission sustaining process Ic is shortened even though first sustaining pulses $IP_{X1}$ have a wide pulse width, because each of the sustaining pulses $IP_{X2}$ to be supplied subsequently has a narrow pulse width.

In addition, according to the present invention, pulse width $T_a$ of said first sustaining pulses $IP_{X1}$ in each subfield excluding the first subfield is set narrower, in proportion to the increase of the frequency of the sustaining discharge performed in the subfield immediately before each subfield.

For example, as shown in FIG. 6, the pulse width $T_{a3}$ of the first sustaining pulses $IP_{X1}$ to be supplied first during the light emission sustaining process Ic of the subfield SF3 is narrower than the pulse width $T_{a2}$ of the first sustaining pulses $IP_{X1}$ to be supplied first during the light emission sustaining process Ic of the subfield SF2. Said pulse width $T_{a2}$ is narrower than pulse width $T_{a1}$ of the first sustaining pulses $IP_{X1}$ to be supplied first during the light emission sustaining process Ic of the subfield SF1. That is, the narrowest pulse width is the pulse width $T_{a3}$ of the first sustaining pulses $IP_{X1}$ to be supplied first during the light emission sustaining process Ic of the subfield SF3 which follows the subfield SF4 in which a sustaining discharge is generated by the largest number of frequency. The second narrowest is pulse width $T_{a2}$ of the first sustaining pulses $IP_{X1}$ to be supplied first during the light emission sustaining process Ic of the subfield SF2 which comes after the subfield SF3 in which the number of frequency of sustaining discharge is the second largest. That is, the relation between the sizes of pulse widths $T_{a3}T_{a1}$ of the first sustaining pulses $IP_{X1}$ to be supplied first during the light emission sustaining process Ic of each subfield SF3–SF1 is as follows.

$$T_{a1}>T_{a2}>T_{a3}$$

As a result, according to the present invention, the pulse width of the first sustaining pulses $IP_{X1}$ to be supplied first during the light emission sustaining process Ic is set narrower in proportion to the increase in the frequency of sustaining discharge performed during the light emission sustaining process Ic of the subfield immediately before the subfield, with consideration given to the following points.

1) The more frequently sustaining discharge takes place, the more charged particles remain in a discharge cell.

2) Normal sustaining discharge takes place even though the pulse width of the sustaining pulses is narrowed, if a large amount of charged particles exist in a discharge cell.

Therefore, according to the present invention, it becomes possible to further decrease the time required for each light emission sustaining process Ic by the extra amount of time obtained by narrowing the pulse width $T_a$ of the first sustaining pulses $IP_{X1}$.

As is shown in FIG. 7, the subfield immediately before the first subfield SF4 is the subfield SF1, which is the end of the preceding field. However, a preliminary period AU for changing driving sequences is placed after the subfield SF1, as shown in FIGS. 6 and 7. As a result, most of the charged particles formed during the light emission sustaining process Ic of the subfield SF1 disappear during said preliminary period AU. Therefore, the pulse width of the first sustaining pulses $IP_{X1}$ to be supplied first during the light emission sustaining process Ic of the first subfield SF4 is set to a relatively wide pulse width $T_{a4}$, as shown in FIG. 6.

The method for driving a plasma display panel according to the present invention is also applicable to a plasma display apparatus in which the tone of the plasma display panel is driven by using a light emission driving format different from the light emission driving format shown in FIG. 5.

Figure 8:
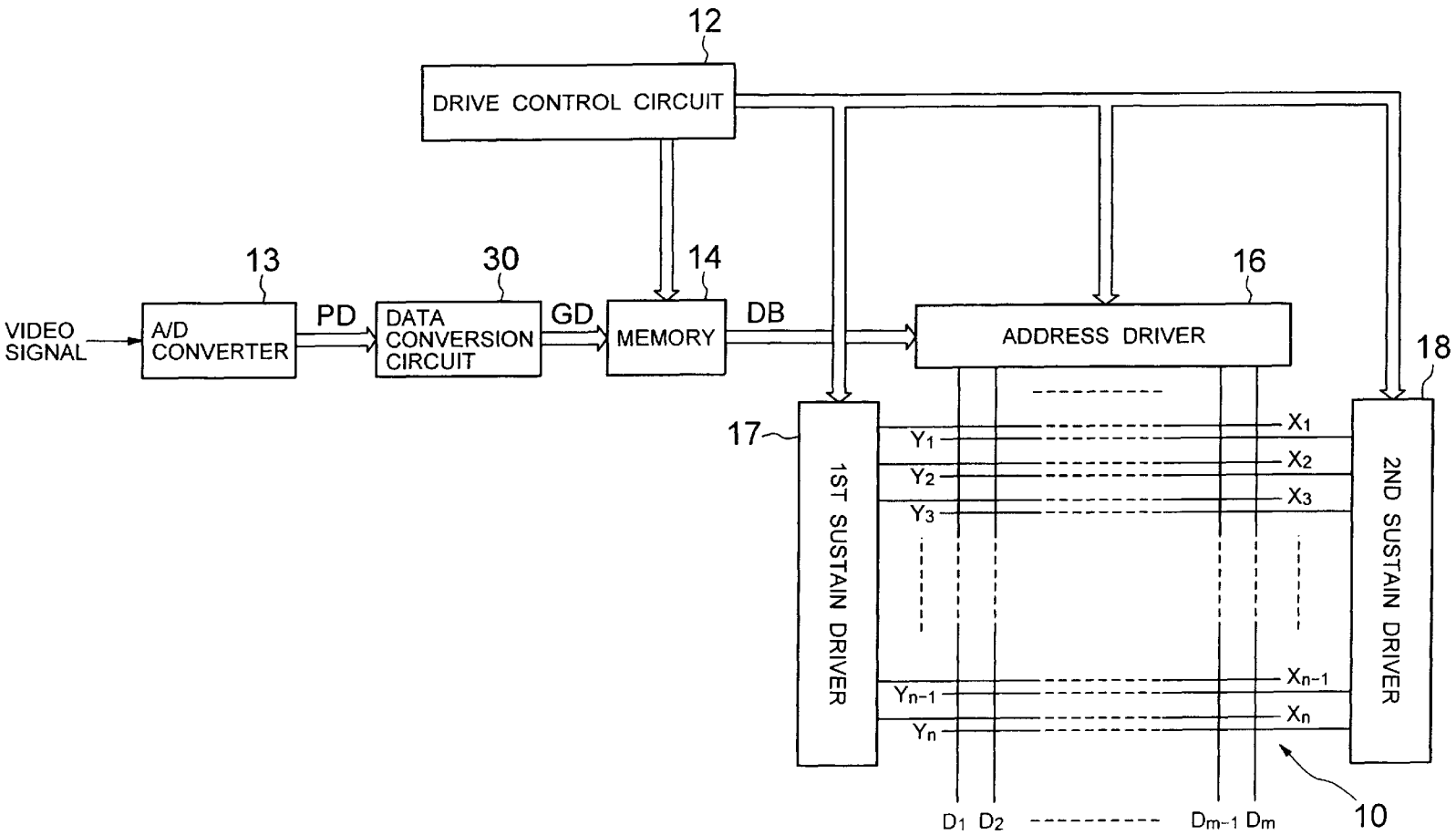
FIG. 8 shows another configuration of a plasma display apparatus for driving a plasma display panel in accordance with the driving method of the present invention.

FIG. 8 is a diagram showing another configuration of a plasma display apparatus according to the present invention.

In FIG. 8, the plasma display panel PDP 10 comprises m column electrodes $D_1$–$D_m$ and n row electrodes $X_1$–$X_n$ and $Y_1$–$Y_n$ which intersect each of the column electrodes. A pair of $X_i$ ($1<i<n$) and $Y_i$ ($1<i<n$) of these row electrodes $X_1$–$X_n$ and $Y_1$–$Y_n$ forms a display line of the PDP 10, the first to n-th display lines. Between the column electrode D and the row electrodes X and Y, a discharge space is formed containing discharge gas. A discharge cell corresponding to a picture element is formed at the intersection of each row electrode pair and each column electrode with the discharge space in between.

Figure 9:
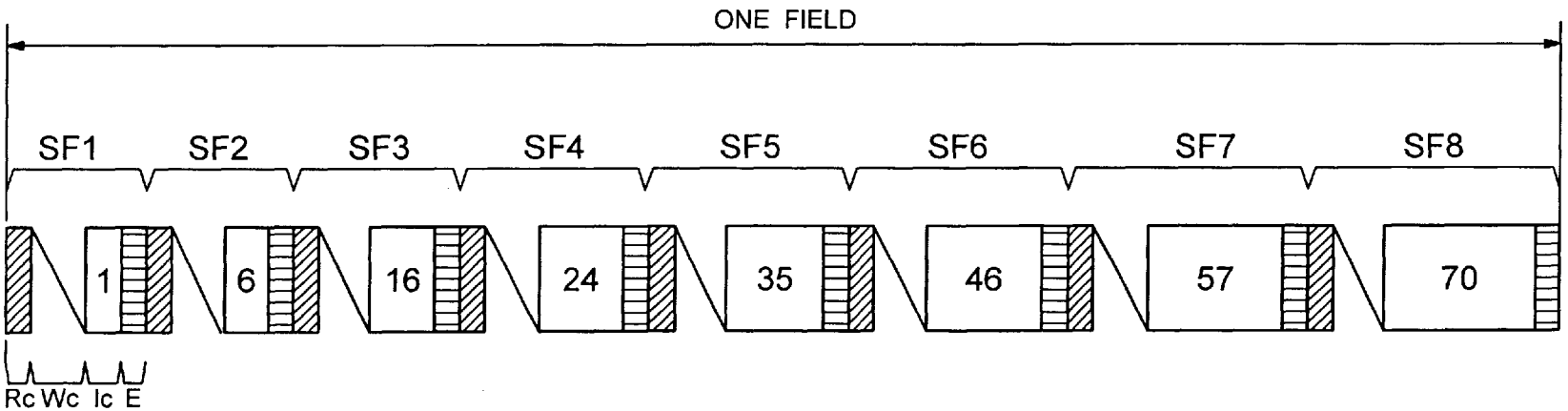
FIG. 9 is a diagram showing an example of the light emission driving format used in a drive control circuit 12.

A driver comprising a drive control circuit 12, an A/D converter 13. a data conversion circuit 30, a memory 14, an address driver 16, a first sustain driver 17, and a second sustain driver 18 drives the tone of said PDP 10 in accordance with the light emission driving format shown in FIG. 9. In the light emission driving format shown in FIG. 9, the display period of one field is divided into eight subfields SF1–SF8.

The A/D converter 13 in said driver samples an input video signal, converts the sampled signal into 8-bit picture element data PD for each picture element, and sends said PD to the data conversion circuit 30.

Figure 10:
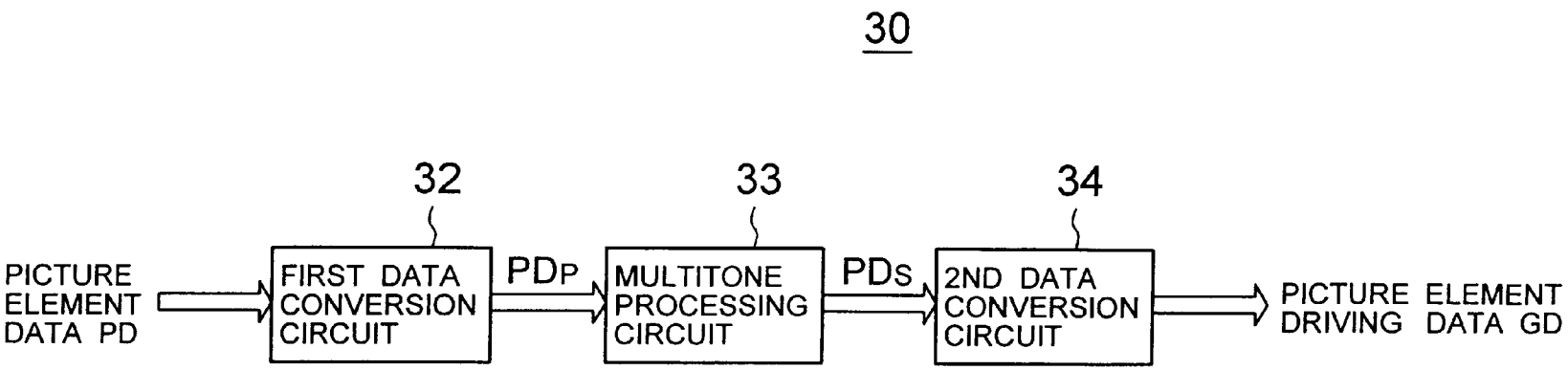
FIG. 10 is a diagram showing the internal configuration of a data conversion circuit 30.

FIG. 10 is a diagram showing the internal configuration of said data conversion circuit 30.

Figure 11:
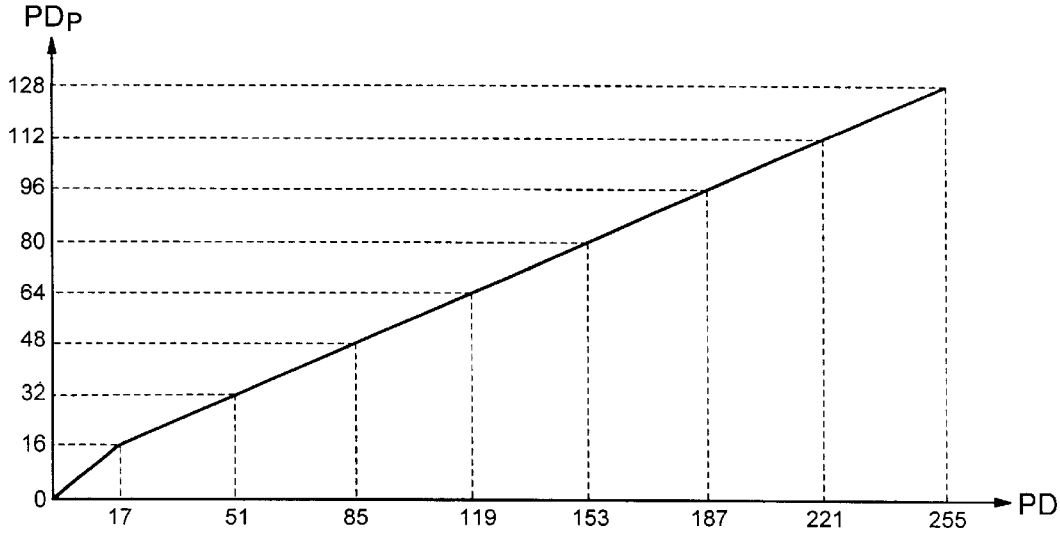
FIG. 11 is a diagram showing the conversion characteristics in a first data conversion circuit 32.

In FIG. 10, the first data conversion circuit 32 converts the above-mentioned picture element data PD, which can display 256 tones of brightness, "0"-"255", with 8 bits, into 8-bit brightness controlled picture element data PDP in accordance with the conversion characteristics shown in FIG. 11. Then the first data conversion circuit 32 sends said brightness controlled picture element data $PD_p$ to a multitone processing circuit 33.

The multitone processing circuit 33 performs multitone processing such as error dispersion processing, dither processing and the like on said 8-bit brightness controlled picture element data $PD_p$. Thereby, the multitone processing circuit 33 obtains multitone picture element data $PD_s$ with the number of bits compressed into 4 while still sustaining the number of tones of brightness represented visibly at nearly 256.

Figure 12:
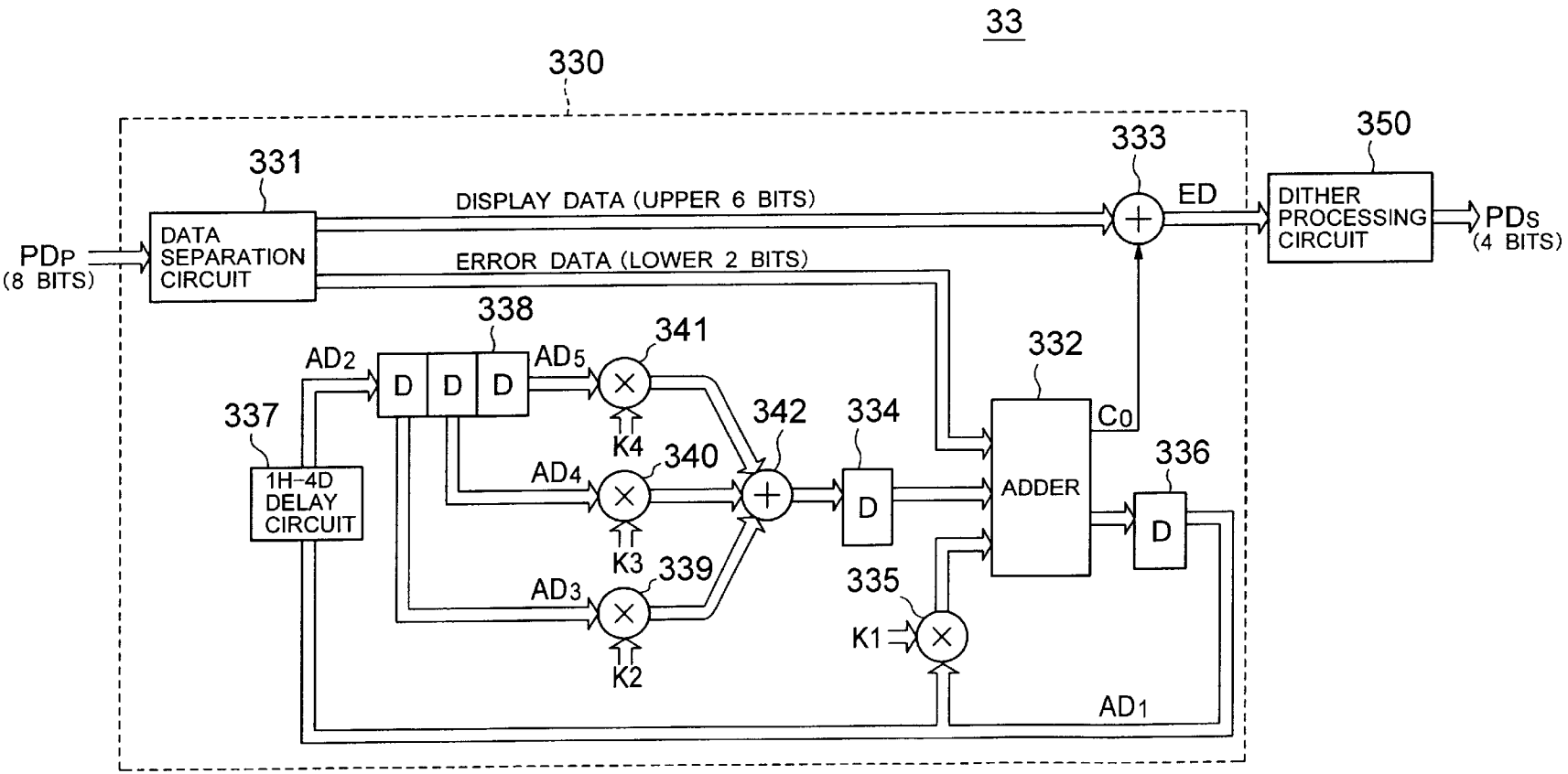
FIG. 12 is a diagram showing the internal configuration of a multitone processing circuit 33.

FIG. 12 is a diagram showing the internal configuration of the multitone processing circuit 33.

As shown in FIG. 12, said multitone processing circuit 33 comprises an error dispersion processing circuit 330 and a dither processing circuit 350.

First, a data separation circuit 331 in the error dispersion processing circuit 330 separates the lowest two bits of the 8-bit brightness controlled picture element data $PD_p$ sent from the first data conversion circuit 32 as error data and the upper six bits thereof as display data. An adder 332 adds said error data to the delay output from a delay circuit 334 and the multiplication output from a coefficient multiplier 335, and sends the added value obtained to a delay circuit 336. The delay circuit 336 delays the added value sent from the adder 332 by a delay time D having the same time as the sampling period of said picture element data PD, and sends said delayed value to the coefficient multiplier 335 and to a delay circuit 337 as delayed addition signal $AD_1$. The coefficient multiplier 335 multiplies said delayed addition signal $AD_1$ by a predetermined coefficient K1 (for example, "7/16"), and sends the multiplied result to the adder 332. The delay circuit 337 further delays said delayed addition signal $AD_1$ by a time (1 horizontal scanning period–said delay time D×4), and sends the further delayed result to a delay circuit 338 as a delayed addition signal $AD_2$. The delay circuit 338 further delays said delayed addition signal $AD_2$ by said delay time D, and sends the result to a coefficient multiplier 339 as a delayed addition signal $AD_3$. The delay circuit 338 further delays said delayed addition signal $AD_2$ by the time of said delay time D×2, and sends the result to a coefficient multiplier 340 as a delayed addition signal $AD_4$. In addition, the delay circuit 338 delays said delayed addition signal $AD_2$ by the time of said delay time D×3, and sends the result to a coefficient multiplier 341 as a delayed addition signal $AD_5$. The coefficient multiplier 339 multiplies said delayed addition signal $AD_3$ by a predetermined coefficient $K_2$ (for example, "3/16"), and sends the multiplied result to an adder 342. The coefficient multiplier 340 multiplies said delayed addition signal $AD_4$ by a predetermined coefficient $K_3$ (for example, "5/16"), and sends the multiplied result to the adder 342. The coefficient multiplier 341 multiplies said delayed addition signal $AD_5$ by a predetermined coefficient $K_4$ (for example, "1/16"), and sends the multiplied result to the adder 342. The adder 342 adds the multiplied results sent from the coefficient multipliers 339, 340 and 341, and sends an adding signal based on the sum to the delay circuit 334. The delay circuit 334 delays such adding signal by said delay time D, and sends it to the adder 332. The adder 332 generates a carry out signal $C_o$ with logical level "0" when there is no carry to the result of addition of error data sent from the data separation circuit 331, delay output from the delay circuit 334, and multiplication output from the coefficient multiplier 335, and generates a carry out signal $C_o$ with logical level "1" when there is a carry, and sends said signal to an adder 333. The adder 333 adds said carry out signal $C_o$ to the display data sent from the data separation circuit 331, and outputs the result as 6-bit error dispersion processing picture element data ED.

Figure 13:
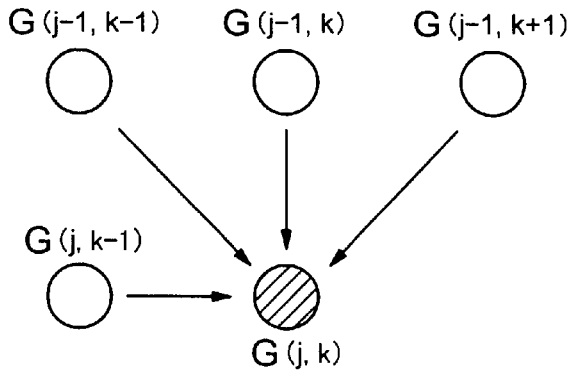
FIG. 13 is a diagram describing the operation of an error dispersion processing circuit 330.

The operation performed by the error dispersion processing circuit 330 will be described below using an example in which error dispersion processing picture element data ED corresponding to picture element G (j, k) of the PDP 10 shown in FIG. 13 are obtained.

First, the error data corresponding to the picture element G (j, k−1) to the left of said picture element G (j, k), picture element G (j−1, k−1) to the upper left thereof, picture element G (j−1, k) directly above thereof, and picture element G (j−1, k+1) to the upper right thereof are shown below.

Error data corresponding to picture element G (j, k−1): delayed addition signal $AD_1$ Error data corresponding to picture element G (j−1, k+1): delayed addition signal $AD_3$ Error data corresponding to picture element G (j−1, k): delayed addition signal $AD_4$ Error data corresponding to picture element G (j−1, k−1): delayed addition signal $AD_5$ The adder 332 adds each of these error data with the weight of predetermined coefficients $K_1$–$K_4$ as described above. In addition, the adder 332 adds the lowest two bits of said brightness controlled picture element data PDP, namely, error data corresponding to picture element G (j, k), to this added result. The adder 333 then adds the upper six bits of the brightness controlled picture element data $PD_p$, namely, display data of picture element G (j, k), to a carry out signal $C_o$ obtained by the addition by the adder 332, and outputs the result as error dispersion processing picture element data ED.

That is, the error dispersion processing circuit 330 regards the upper six bits of brightness controlled picture element data $PD_p$ as display data, and regards the lower two bits as error data. The error dispersion processing circuit 330 obtains error dispersion processing picture element data ED by influencing said display data with the result of the weighted addition of said error data obtained for each peripheral picture element G (j, k−1), G (j−1, k+1), G (j−1, k), and G (j−1, k−1). By such operation, the brightness of the lower two bits of the original picture element {G (j,k)} is artificially represented by the above-mentioned peripheral picture elements. Therefore, it becomes possible to display the brightness tones equal to 8-bit picture element data PD by using a fewer number of bits than eight, namely, by using 6-bit display data. In this case, if the coefficient for error dispersion is added uniformly to each picture element, the quality of the image may be deteriorated because noise due to the error dispersion pattern sometimes becomes visible. In order to cope with this problem, error dispersion coefficients $K_1$–$K_4$ to be allocated to each of the four picture elements may be changed for each field in the same manner as in the case of the dither coefficients to be described.

The dither processing circuit 350 shown in FIG. 12 performs dither processing on the error dispersion processing picture element data ED sent from said error dispersion processing circuit 330. Dither processing is performed in order to represent one intermediate brightness by using a plurality of adjoining picture elements. For example, the addition is performed by grouping four adjoining picture elements to the right and left and above and below each other into one group, then allocating one of four dither coefficients a–d having different values to each picture element data corresponding to each picture element of one group. By said dither processing, four combinations of different intermediate display levels for four picture elements are possible. However, if the dither pattern of the dither coefficients a–d is added uniformly to each picture element, the quality of the image may be deteriorated because noise due to this dither pattern is sometimes visible.

Therefore, the dither processing circuit 350 is designed to change said dither coefficients a–d to be allocated to each of the four picture elements for each field.

Figure 14:
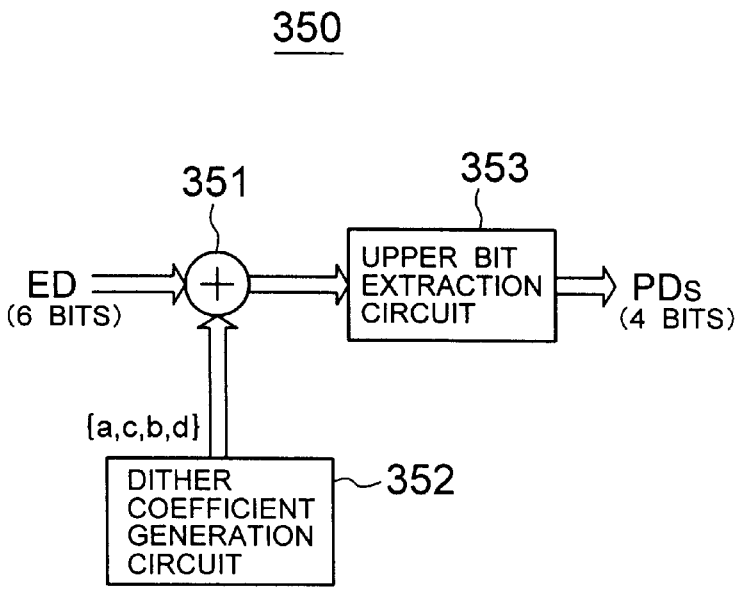
FIG. 14 is a diagram showing the internal configuration of a dither processing circuit 350.

FIG. 14 is a diagram showing the internal configuration of said dither processing circuit 350.

Figure 15:
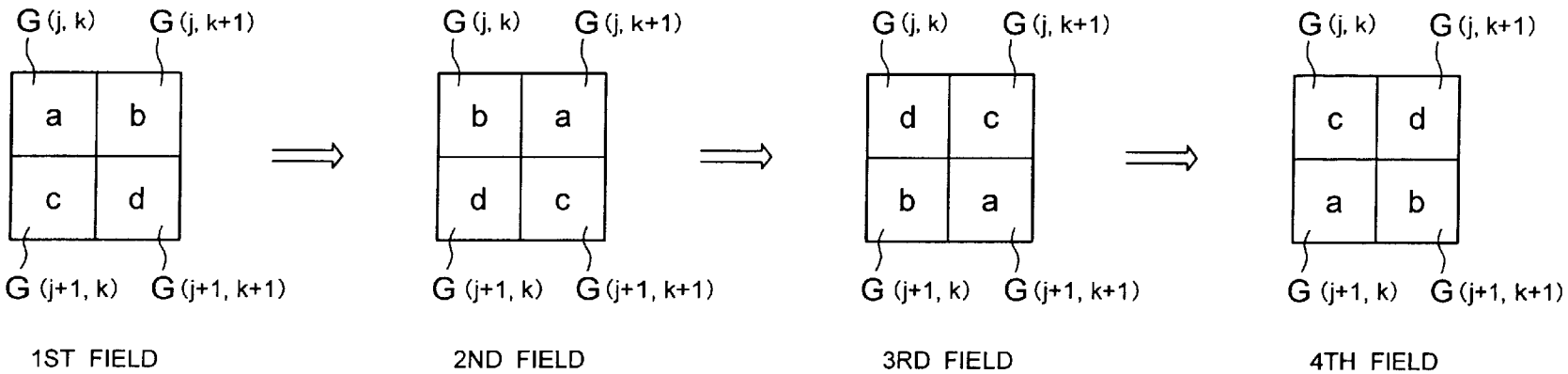
FIG. 15 is a diagram describing the operation of a dither processing circuit 350.

In FIG. 14, a dither coefficient generation circuit 352 generates dither coefficients a, b, c and d to be allocated to each of the four picture elements adjoining each other, namely, picture element G (j, k), picture element G (j, k+1), picture element G (j+1, k), and picture element G (j+1, k+1), as shown in FIG. 15, and sends said coefficients to an adder 351. In this case, the dither coefficient generation circuit 352 changes said dither coefficients a–d to be allocated to each of the four picture elements for each field, as shown in FIG. 15.

That is, dither coefficients a–d are generated so as to be allocated to each picture element as follows.

In the first field,

Picture element G (j, k): dither coefficient a

Picture element G (j, k+1): dither coefficient b

Picture element G (j+1, k): dither coefficient c

Picture element G (j+1, k+1): dither coefficient d

In the second field,

Picture element G (j, k): dither coefficient b

Picture element G (j, k+1): dither coefficient a

Picture element G (j+1, k): dither coefficient d

Picture element G (j+1, k+1): dither coefficient c

In the third field,

Picture element G (j, k): dither coefficient d

Picture element G (j, k+1): dither coefficient c

Picture element G (j+1, k): dither coefficient b

Picture element G (j+1, k+1): dither coefficient a, and

In the fourth field,

Picture element G (j, k): dither coefficient c

Picture element G (j, k+1): dither coefficient d

Picture element G (j+1, k): dither coefficient a

Picture element G (j+1, k+1): dither coefficient b

The operation in the first field through the fourth field is executed repeatedly. That is, the operation returns to that in the first field when the dither coefficient generation operation in the fourth field is completed, and the above-mentioned operation is repeated.

The adder 351 adds each of said dither coefficients a–d to the error dispersion processing picture element data ED corresponding to picture element G (j, k), picture element G (j, k+1), picture element G (j+1, k), and picture element G (j+1, k+1) respectively, and sends the dither added picture element data obtained to an upper bit extraction circuit 353.

In the first field shown in FIG. 15, for example, the adder 351 sends the following values as the dither added picture element data to the upper bit extraction circuit 353.

Error dispersion processing picture element data ED corresponding to picture element G (j, k)+dither coefficient a Error dispersion processing picture element data ED corresponding to picture element G (j, k+1)+dither coefficient b Error dispersion processing picture element data ED corresponding to picture element G (j+1, k)+dither coefficient c Error dispersion processing picture element data ED corresponding to picture element G (j+1, k+1)+dither coefficient d The upper bit extraction circuit 353 extracts upper four bits of said dither added picture element data, and sends them to a second data conversion circuit 34 shown in FIG. 10 as multitone picture element data $PD_s$.

The second data conversion circuit 34 converts said 4-bit multitone picture element data $PD_s$ into 8-bit picture element driving data GD in accordance with a conversion table as shown in FIG. 16, and sends said converted data to the memory 14.

The memory 14 writes said picture element driving data GD sequentially in accordance with a write signal coming from the drive control circuit 12. Each time the writing of picture element driving data GD for one screen is completed, the memory 14 performs a read operation described below. Said picture element driving data GD for one screen contains (n×m) picture element driving data GD including picture element driving data $GD_{11}$ corresponding to the picture element of the first row and the first column through picture element driving data $GD_{nm}$ corresponding to the picture element of the n-th row and the m-th column.

First, the memory 14 regards the first bit, which is the least significant bit, of each picture element driving data $GD_{11}$–$GD_{nm}$, as picture element driving data bit $DB1_{11}$–$DB1_{nm}$. The memory 14 reads these bits by one display line at a time, and sends them to the address driver 16. Next, the memory 14 regards the second bit of each picture element driving data $GD_{11}$–$GD_{nm}$ as picture element driving data bit $DB2_{11}$–$DB2_{nm}$. The memory 14 reads these bits by one display line at a time, and sends them to the address driver 16. In the same manner, the memory 14 separates the third bit through the eighth bit of the 8-bit picture element driving data GD, reads the picture element driving data bit DB3–DB8 of each bit by one display line at a time, and sends them to the address driver 16.

The memory 14 matches each of the picture element driving data bit DB1–DB8 to each subfield SF1–SF8 shown in FIG. 9, and reads said DB1–DB8 sequentially at the timing of each subfield.

The drive control circuit 12 generates various kinds of timing signals for driving the tone of the PDP 10 in accordance with the light emission driving format shown in FIG. 9, and sends said timing signals to the address driver 16, the first sustain driver 17, and the second sustain driver 18.

Figure 17:
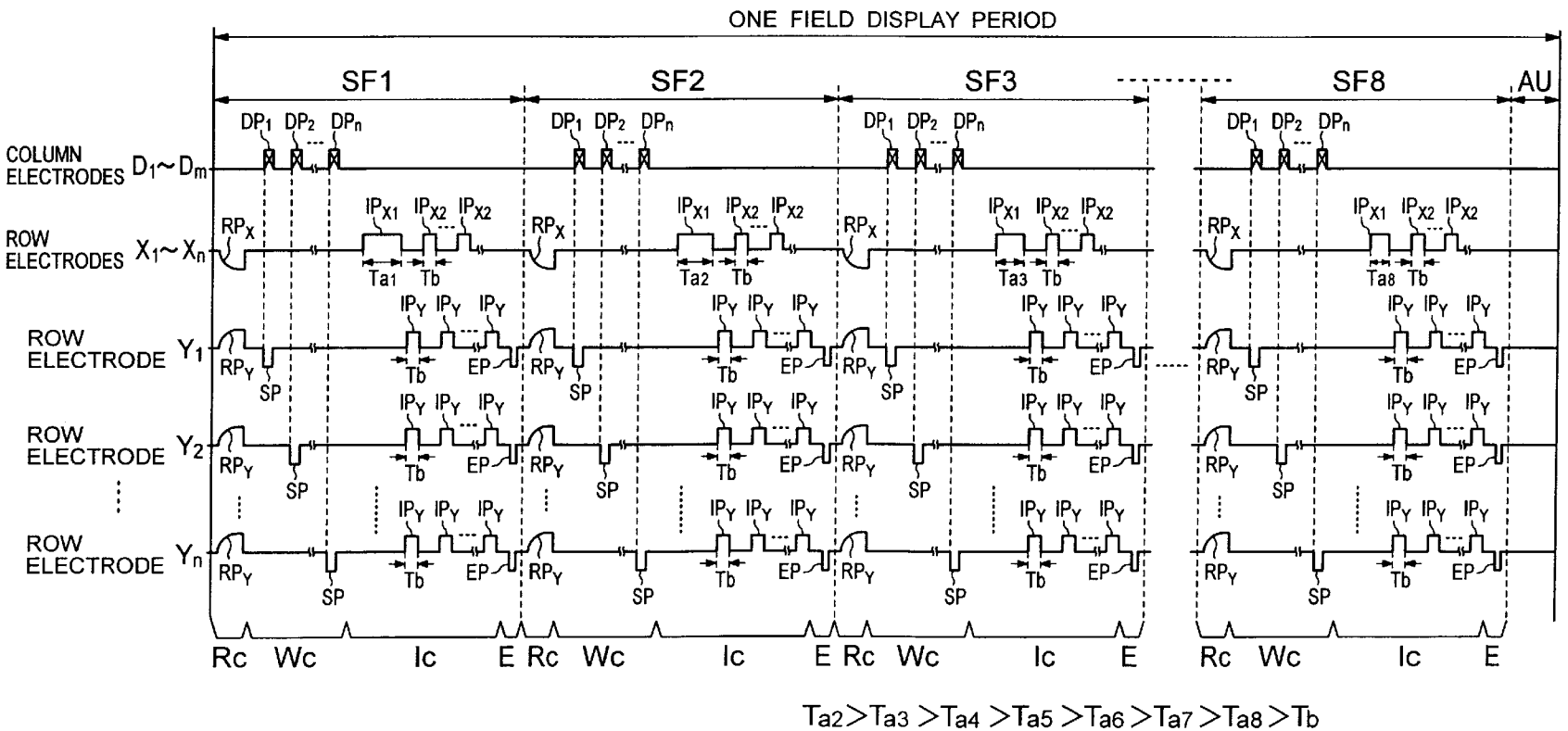
FIG. 17 is a diagram showing various kinds of driving pulses to be supplied to the column electrodes and the row electrodes of the PDP 10 in accordance with the light emission driving format shown in FIG. 9 and their supply timing.

FIG. 17 is a diagram showing various kinds of driving pulses to be supplied to the PDP 10 by the address driver 16, the first sustain driver 17, and the second sustain driver 18 respectively in response to various timing signals sent from the drive control circuit 12, and their supply timing.

In FIG. 17, during the simultaneous reset process Rc which is executed first in each subfield, the first sustain driver 17 generates negative reset pulses $RP_x$ and supplies said pulses to the row electrodes $X_1$–$X_n$. Simultaneously with the generation of said reset pulses $RP_x$, the second sustain driver 18 generates positive reset pulses $RP_Y$ and supplies said pulses to the row electrodes $Y_1$–$Y_n$. In response to the simultaneous supply of these reset pulses $RP_x$ and $RP_Y$, the reset discharge takes place in all the discharge cells of the PDP 10, and a wall charge is formed in each discharge cell. Thereby, all the discharge cells are initialized to a "light emission cell" state.

During the picture element data write process Wc, first, the address driver 16 generates picture element data pulses having a pulse voltage corresponding to picture element driving data bit DB sent from the memory 14. In the subfield SF1, for example, picture element driving data bit $DB_1$ is sent from the memory 14, so the address driver 16 generates picture element data pulses having a pulse voltage corresponding to the logical level of the picture element driving data bit $DB_1$. In this case, the address driver 16 generates picture element data pulses of high voltage when the logical level of said picture element driving data bit DB is "1" and generates picture element data pulses of low voltage (0 volt) when the logical level is "0". Then the address driver 16 supplies said picture element data pulses to the column electrodes $D_1$–$D_m$ sequentially as picture element data pulse groups $DP_1$–$DP_n$ grouped for each display line during the picture element data write process Wc of each subfield, as shown in FIG. 17.

In addition, during said picture element data write process Wc, the second sustain driver 18 generates negative scanning pulses SP at the same timing as the supply timing of each of the picture element data pulse groups $DP_1$–$DP_n$, and supplies said pulses to the row electrodes $Y_1$–$Y_n$ sequentially, as shown in FIG. 17. In this case, only a discharge cell at the intersection of a display line to which said scanning pulses SP were supplied and a "column" to which the picture element data pulses of high voltage were supplied generates a selective erasing discharge. By such selective erasing discharge, the wall charge formed in discharge cell disappears. Thus, such discharge cell is shifted to a "non-light emission cell" state. On the other hand, a discharge cell to which the scanning pulses SP were supplied and to which picture element data pulses of low voltage were also supplied simultaneously does not generate said selective erasing discharge. Thus, this discharge cell is sustained at the state initialized during the simultaneous reset process Rc, namely, at a "light emission cell" state.

That is, during the picture element data write process Wc, each discharge cell is set to a "light emission cell" state or a "non-light emission cell" state in accordance with the picture element data corresponding to an input video signal. Thus, what is called picture element data write is performed.

Next, during the light emission sustaining process Ic in each subfield, the first sustain driver 17 and the second sustain driver 18 supply positive sustaining pulses $IP_X$ and $IP_Y$ to the row electrodes $X_1$–$X_n$ and $Y_1$–$Y_n$ respectively and alternately, as is shown in FIG. 17. When the frequency to supply sustaining pulses IP repeatedly during the light emission sustaining process Ic in the subfield SF1 is "1", the supply frequency (or the supply period) of sustaining pulses IP to be repeated during the light emission sustaining process Ic in each subfield SF1–SF8 is as shown below.

SF1: 1

SF2: 6

SF3: 16

SF4: 24

SF5: 35

SF6: 46

SF7: 57

SF8: 70

By such operation, only a discharge cell at which a wall charge remains, namely, only a discharge cell at a "light emission cell" state, generates a sustaining discharge each time said sustaining pulses $IP_X$ and $IP_Y$ are supplied thereto, and sustains its light emitting state due to said sustaining discharge by said frequency.

During the erasing process E, which is performed at the end of each subfield, the second sustain driver 18 supplies erasing pulses EP as shown in FIG. 17 to the row electrodes $Y_1$–$Y_n$. Thereby, erasing discharge takes place in all the discharge cells, and all the wall charge remaining in each discharge cell disappears.

A series of such processes as said simultaneous reset process Rc, the picture element data write process Wc, the light emission sustaining process Ic, and the erasing process E are executed for each subfield in the plasma display apparatus shown in FIG. 8, as shown in FIG. 17. By said driving, the light emission due to said sustaining discharge is repeated by a frequency allocated to the subfield only by a discharge cell in which the selective erasing discharge did not take place during the picture element data write process Wc of each subfield, namely, only by a "light emission cell".

In this case, the logical level of the first bit through the eighth bit of picture element driving data GD shown in FIG. 16 determines whether a discharge cell is to be a "light emission cell" or a "non-light emission cell" during the picture element data write process Wc of each subfield SF1–SF8. That is, when the logical level of a bit in picture element driving data GD is "1", as shown by the black circles in FIG. 16, selective erasing discharge takes place during the picture element data write process Wc of the subfield SF corresponding to the bit digit. Thus, the discharge cell is set to be a "non-light emission cell" by said selective erasing discharge. On the other hand, when the logical level of a bit in said picture element driving data GD is "0", said selective erasing discharge does not take place during the picture element data write process Wc of the subfield SF corresponding to the bit digit. Thus, the discharge cell is sustained at the "light emission cell" state, and light emission due to the sustaining discharge is repeated during the light emission sustaining process Ic of the subfield SF corresponding to the bit digit, as shown by the circles in FIG. 16. As a result, various kinds of intermediate brightness are displayed gradationally by the total of light emission frequency performed during the light emission sustaining process Ic of each subfield SF1–SF8. In this case, the number of bit patterns possible for the 8-bit picture element driving data GD to form is only nine, as shown in FIG. 16. Therefore, it becomes possible to represent intermediate brightness in nine tones with the respective light emission brightness ratios given below by the driving operation using said nine systems of picture element driving data GD.

{0, 1, 7, 23, 47, 82, 128, 185, 255 }

Said picture element data PD can originally represent 256 stages of half tones using eight bits. In order to achieve a brightness display having nearly 256 stages of half tones by said 9-tone driving operation, the multitone processing circuit 33 performs multitone processing such as error dispersion processing and dither processing.

In the driving operation by means of the nine kinds of picture element driving data GD as shown in FIG. 16, a discharge cell in the first subfield SF1 is set to be a "light emission cell" without fail excluding the case in which the brightness indication is "0", and light emission is performed. As shown by the white circles, a subfield in which light emission is performed is followed by another until selective erasing discharge takes place in and after the subfield SF2. In this case, once the selective erasing discharge takes place, it takes place consecutively in the subsequent subfields as shown by the black circles, and the discharge cell remains in the "non-light emission cell" state. That is, two states exist in the display period of one field, namely, a consecutive light emission state in which the discharge cell is consecutively at the "light emission cell" state as shown by the white circles, and a consecutive non-light emission state in which the discharge cell is consecutively at the "non-light emission cell" state as shown by the black circles. The frequency of the shifting of a discharge cell from a consecutive light emission state to a consecutive non-light emission state is once or less during the display period of one field, and a discharge cell which once has been shifted to a consecutive non-light emission state never returns to a light emission state. That is, there is no light emission pattern in which a consecutive light emission state (white circles) or a consecutive non-light emission state (black circles) reverse each other during one field period. Therefore, said driving operation can control the occurrence of false outlines, which are caused when such a reversed light emission pattern appears in two regions adjoining each other on a screen.

The pulse width of the sustaining pulses to be supplied first during each light emission sustaining process Ic is set wider than that of the subsequent sustaining pulses for said driving operation too.

That is, as shown in FIG. 17, the pulse width $T_a$ of the first sustaining pulses $IP_{X1}$ to be supplied first during the light emission sustaining process Ic is set wider than the pulse width $T_b$ of the sustaining pulses $IP_{X2}$ to be supplied subsequently. Thus, a normal sustaining discharge is generated even though the amount of charged particles remaining in each discharge cell is too small immediately before each light emission sustaining process Ic. In addition, because many charged particles are formed in each discharge cell due to the sustaining discharge generated by said first sustaining pulses $IP_{X1}$, a normal sustaining discharge can be generated even though the pulse width of the sustaining pulses to be supplied subsequently, namely, the width $T_b$ of sustaining pulses $IP_{X2}$, is a narrow pulse width. Therefore, even though the first sustaining pulses $IP_{X1}$ have a wide pulse width, the time required for each light emission sustaining process Ic is decreased because each of the sustaining pulses $IP_{X2}$ to be supplied subsequently has a narrower pulse width.

In addition, the pulse width $T_a$ of said first sustaining pulses $IP_{X1}$ in each subfield SF2–SF8, excluding the first subfield SF1, is set narrower in proportion to the increase of the total frequency of sustaining discharges that occurred between the head of one field and the time when the first sustaining pulses $IP_{X1}$ are supplied. In this case, according to the light emission pattern shown in FIG. 16, the nearer a subfield is to the end of the display period of one field, the larger the total frequency of sustaining discharges taking place in subfields up to the one immediately before the subfield. For example, as shown in FIG. 17, the pulse width $T_{a3}$ of the first sustaining pulses $IP_{X1}$ to be supplied first during the light emission sustaining process Ic of the subfield SF3 is narrower than the pulse width $T_{a2}$ of the first sustaining pulses $IP_{X1}$ to be supplied first during the light emission sustaining process Ic of the subfield SF2. Similarly, the pulse width $T_{a4}$ of the first sustaining pulses $IP_{X1}$ to be supplied first during the light emission sustaining process Ic of the subfield SF4 is narrower than the pulse width $T_{a3}$ of the first sustaining pulses $IP_{X1}$ to be supplied first during the light emission sustaining process Ic of the subfield SF3.

That is, the relation between the size of pulse widths $T_{a2}$–$T_{a8}$ of the first sustaining pulses $IP_{X1}$ to be supplied first in each subfield SF2–SF8 by said driving operation shown in FIGS. 9, 16 and 17 is as given below.

$$T_{a2}>T_{a3}>T_{a4}>T_{a5}>T_{a6}>T_{a7}>T_{a8}$$

Thus, the time required for each light emission sustaining process Ic can be decreased by the extra amount of time obtained by narrowing the pulse width $T_a$ of the first sustaining pulses $IP_{X1}$.

In this case, the subfield immediately before the first subfield SF1 is the subfield SF8, the last subfield in the preceding field. A preliminary period AU for changing the various kinds of sequences given above is placed after this subfield SF8. In this case, charged particles formed during the light emission sustaining process Ic of the subfield SF8 gradually disappear over the course of time, with most of them disappearing during said preliminary period AU. Therefore, as shown in FIG. 17, the width of the first sustaining pulses $IP_{X1}$ to be supplied first during the light emission sustaining process Ic of the first subfield SF1 is set to a relatively wide pulse width $T_{a1}$.

In the above-mentioned embodiment, the simultaneous reset process Rc and the erasing process E are performed in all the subfields, as shown in the light emission driving format in FIG. 9. However, there is no need to perform these processes in all the subfields.

Figure 18:
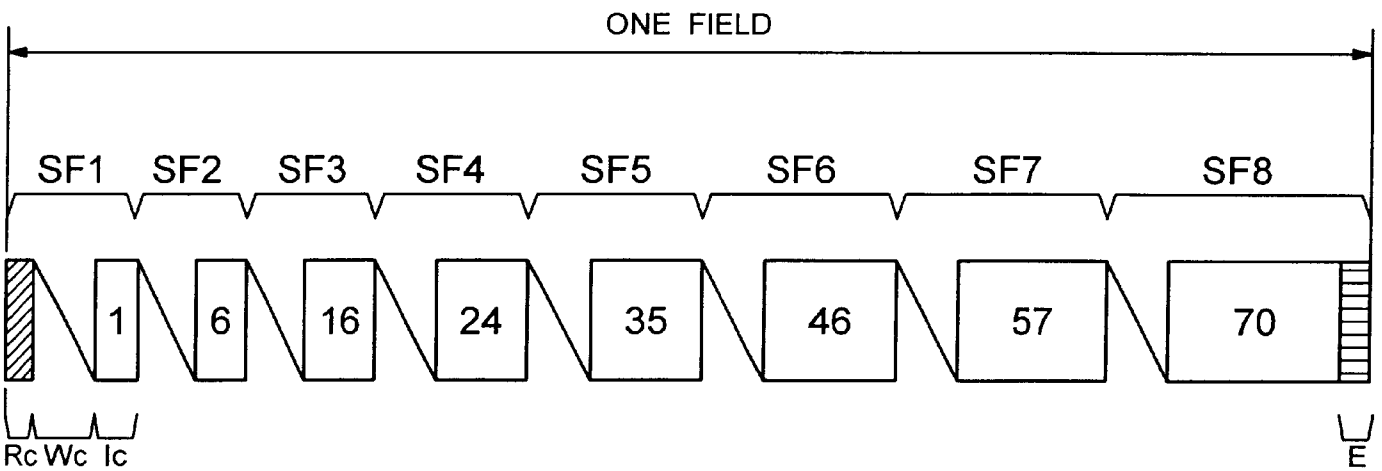
FIG. 18 is a diagram showing another example of a light emission format used in the drive control circuit 12.

FIG. 18 is a diagram showing another example of a light emission driving format used instead of the light emission driving format shown in FIG. 9.

According to the light emission driving format shown in FIG. 18, the picture element data write process Wc and the light emission sustaining process Ic are each performed in each subfield SF1–SF8. In this case, the simultaneous reset process Rc is performed only in the first subfield SF1, and the erasing process E is performed only in the last subfield SF8.

Figure 19:
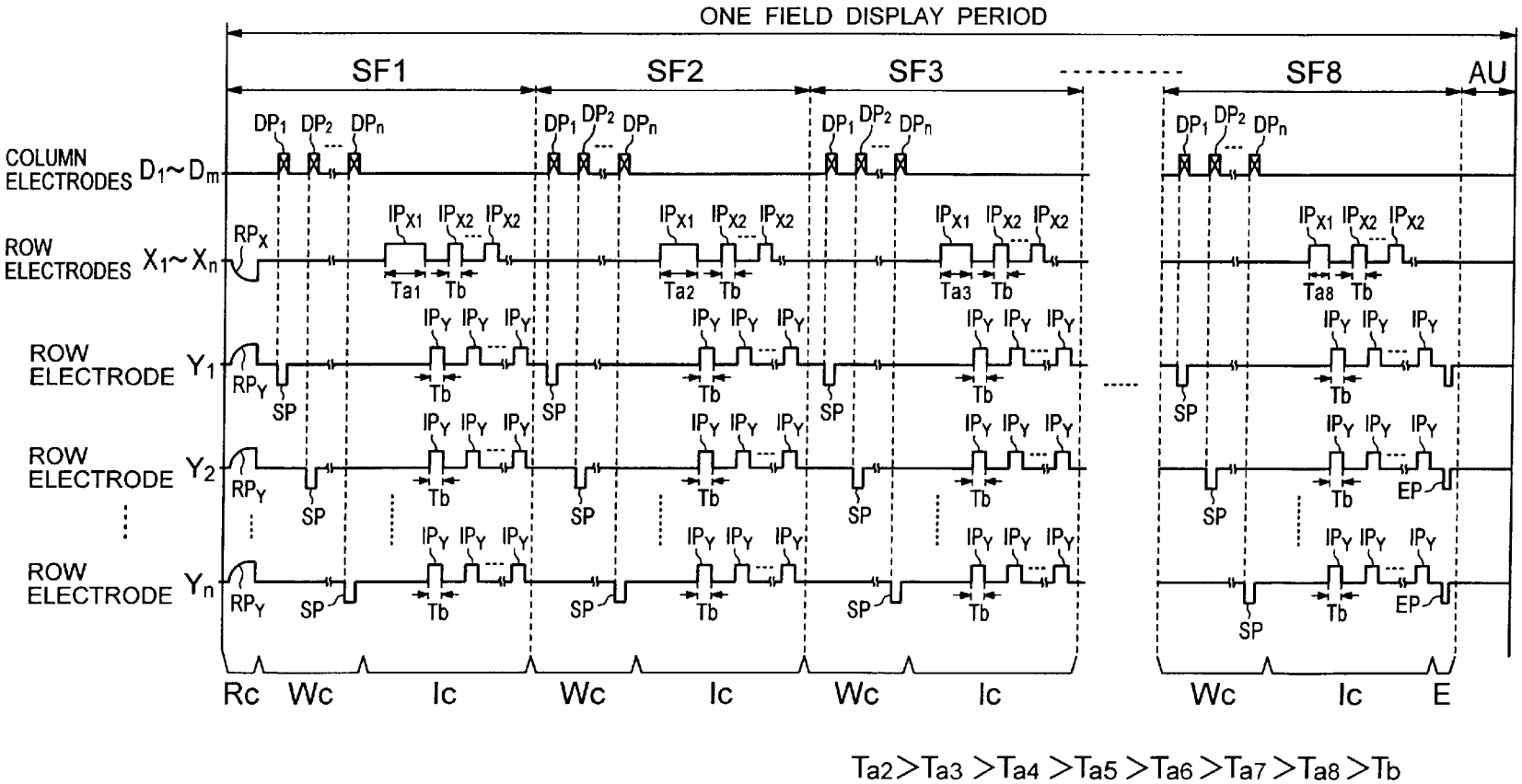
FIG. 19 is a diagram showing various kinds of driving pulses to be supplied to the column electrodes and the row electrodes of the PDP 10 in accordance with the light emission driving format shown in FIG. 18 and their supply timing.

FIG. 19 is a diagram showing various kinds of driving pulses to be supplied to the PDP 10 by the address driver 16, the first sustain driver 17 and the second sustain driver 18 in accordance with the light emission driving format shown in FIG. 18, and their supply timing.

In FIG. 19, during the simultaneous reset process Rc which is performed only in the first subfield SF1, the first sustain driver 17 generates negative reset pulses $RP_X$, and supplies said pulses to the row electrodes $X_1$–$X_n$. In addition, simultaneously with the generation of said reset pulses $RP_X$, the second sustain driver 18 generates positive reset pulses $RP_Y$, and supplies said pulses to the row electrodes $Y_1$–$Y_n$. In response to the simultaneous supply of these reset pulses $RP_X$ and $RP_Y$, reset discharge takes place in all the discharge cells of the PDP 10, and a wall charge is formed in each discharge cell. Thereby, all the discharge cells are initialized to a "light emission cell" state.

During the picture element data write process Wc performed in each subfield SF1–SF8, the address driver 16 supplies said picture element data pulse groups $DP_1$–$DP_n$ sequentially to the column electrodes $D_1$–$D_m$ as shown in FIG. 19. In this case, the second sustain driver 18 generates negative scanning pulses SP at the same timing as the supply timing of each of said picture element data pulse groups $DP_1$–$DP_n$, and supplies them to the row electrodes $Y_1$–$Y_n$ sequentially as shown in FIG. 19. Only a discharge cell at the intersection of a display line to which said scanning pulses SP were supplied and a "column" to which high voltage picture element data pulses were supplied produces selective erasing discharge. Therefore the wall charge formed in such a discharge cell disappears. Thus, such a discharge cell is shifted to the "non-light emission cell" state. On the other hand, a discharge cell to which the scanning pulses SP were supplied and at the same time low voltage picture element data pulses were also supplied does not generate a selective erasing discharge. Thus, this discharge cell is sustained at the state initialized during said simultaneous reset process Rc, namely, at the "light emission cell" state.

During the light emission sustaining process Ic in each subfield, the first sustain driver 17 and the second sustain driver 18 supply positive sustaining pulses $IP_X$ and $IP_y$ to the row electrodes $X_1$–$X_n$ and $Y_1$–$Y_n$ alternately as shown in FIG. 19. In this case, during the light emission sustaining process Ic of each subfield SF1–SF8, the frequency (or the period) of the sustaining pulses IP which are supplied repeatedly is as shown below when the supply frequency during the light emission sustaining process Ic of the subfield SF1 is "1".

SF1:1
SF2:6
SF3:16
SF4:24
SF5:35
SF6:46
SF7:57
SF8:70

In this case, each time the sustaining pulses $IP_x$ and $IP_y$ are supplied, only a discharge cell in which a wall charge remains, namely, only a discharge cell which is in the "light emitting cell" state, discharges and sustains the light emission state due to the discharge for sustaining the light emission state by said frequency.

During the erasing process E, which is performed only at the end subfield SF8, the second sustain driver 18 supplies erasing pulses EP shown in FIG. 19 to the row electrodes $Y_1$–$Y_n$. Thereby, all the discharge cells discharge for erasing simultaneously and all the wall charge remaining in each discharge cell disappears.

FIG. 20 is a diagram showing the conversion table used in the second data conversion circuit 34 during the driving operation shown in FIGS. 18 and 19.

In accordance with the picture element driving data GD obtained from said data conversion table, as shown by the black circles in FIG. 20, selective erasing discharge takes place only during the picture element data write process Wc of one of the subfields SF1–SF8. In this case, the simultaneous reset process Rc for initializing the discharge cells to the "light emission cell" state is performed only in the first subfield SF1. Therefore, as shown by the black circles in FIG. 20, if selective erasing discharge takes place, the discharge cells in the subsequent subfields maintain their "non-light emission cell" state continuously. Therefore, the light emission pattern during the display period of one field is the same as that shown in FIG. 16, and intermediate brightness including 9 tones of light emission brightness ratio of $$\{0, 1, 7, 23, 47, 82, 128, 185, 255\}$$

is displayed.

By the driving operation shown in FIGS. 18 and 20, the same tone display as the tone display during the driving operation shown in FIGS. 9 and 16 is achieved, and at the same time, the frequency of the reset discharge in the display period of one field becomes 1. That is, by the driving operation shown in FIGS. 18 and 20, the frequency of reset discharges causing light emission unrelated to what is being displayed decreases, so the contrast on the screen is improved.

In this case, by the driving operation shown in FIGS. 18 and 20, the width $T_a$ of said first sustaining pulses $IP_x$ is narrowed in the subfields SF2–SF8, excluding the first subfield SF1, in proportion to the increase in the total frequency of the light emission sustaining discharges occurring immediately before the subfield. That is, by setting the width $T_{a2}$–$T_{a8}$ of the first sustaining pulses $IP_{x1}$ to be supplied first in the subfields SF2–SF8 shown in FIG. 19 as $$T_{a2}>T_{a3}>T_{a4}>T_{a5}>T_{a6}>T_{a7}>T_{a8}$$

like the pulse width shown in FIG. 17, the time required for each light emission sustaining process Ic is shortened further.

In accordance with the picture element driving data GD shown in FIG. 20, as shown by the black circles in FIG. 20, selective erasing discharge takes place only during the picture element data write process Wc of one of the subfields SF1–SF8. However, if the amount of charged particles remaining in a discharge cell is too small, normal selective erasing discharge does not take place, and the wall charge in such a discharge cell may not be normally erased.

Therefore, the driving operation is performed in accordance with the picture element driving data GD obtained by using the conversion table shown FIG. 21 rather than that shown in FIG. 20 in the second data conversion circuit 34.

An asterisk "*" in FIG. 21 means that either logical level "1" or logical level "0" will do. A triangle means that selective erasing discharge takes place only when the "*" is logical level "1".

In accordance with the picture element driving data GD shown in FIG. 21, selective erasing discharge takes place during each picture element data write process Wc for at least two successive subfields. In short, even though the first selective erasing discharge is not complete, charged particles are generated by said incomplete selective erasing discharge, so the second erasing discharge takes place normally.

In certain cases, said selective erasing discharge takes place more strongly than a predetermined level in a discharge cell due to uneven quality caused during the manufacture process of the PDP 10. In this case, even though a selective erasing discharge takes place in such a discharge cell, a wall charge of opposite polarity is formed as a surplus charge in the row electrodes X or the row electrodes Y, so the wall charge to be erased remains as it is.

Figure 22:
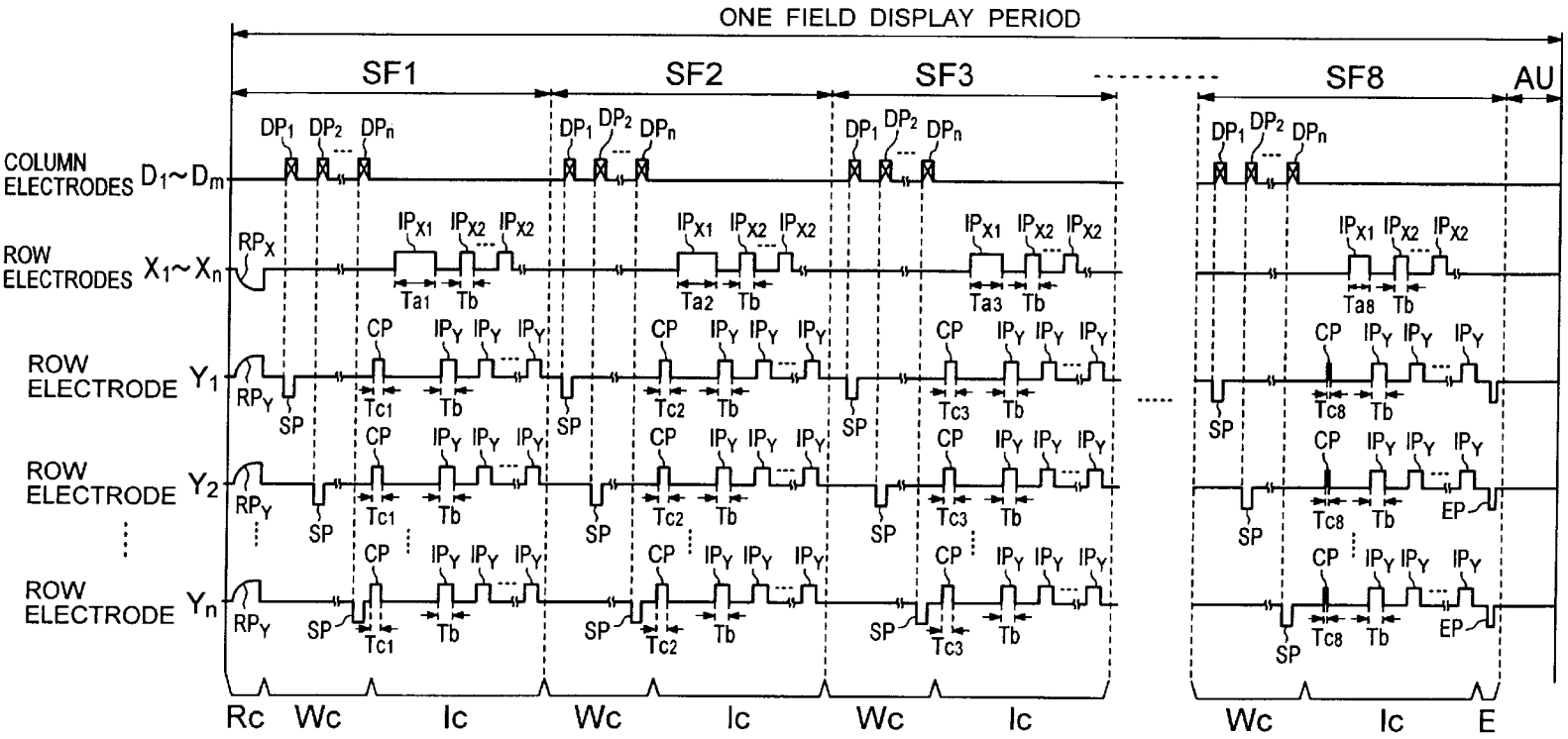
FIG. 22 is a diagram showing various kinds of driving pulses to be supplied to the column electrodes and the row electrodes of the PDP 10 in accordance with the light emission driving format shown in FIG. 18 and another example of their supply timing.

Therefore, as shown in FIG. 22, surplus charge erasing pulses CP to erase said surplus charge may be supplied to the row electrodes $Y_1$–$Y_n$ prior to said first sustaining pulse $IP_{X1}$. By supplying said surplus charge erasing pulses CP, to a discharge cell which should originally be in the "non-light emission cell" state (without wall charge), a surplus charge is formed. In such a discharge cell, an erasing discharge takes place to erase said surplus charge. On the other hand, in a discharge cell in the "light emission cell" state, a discharge does not take place even though said surplus charge erasing pulses CP are supplied to it, because the polarity of the surplus charge erasing pulses CP is opposite to the polarity of the wall charge remaining in the row electrode Y, so the potential difference between the row electrodes does not exceed the discharge start voltage.

In this case, like the width $T_{a2}$–$T_{a8}$ of the first sustaining pulses $IP_{X1}$, the width $T_{C2}$–$T_{C8}$ of the surplus charge erasing pulses CP to be supplied to the subfields SF2–SF8 is narrowed in proportion to the increase in the total frequency of the light emission sustaining discharges generated immediately before said subfields. That is, $$T_{c2}>T_{c3}>T_{c4}>T_{c5}>T_{c6}>T_{c7}>T_{c8}.$$

The subfield immediately before the first subfield SF1 is SF8, the last subfield in the preceding field. A preliminary period AU for changing the various kinds of sequences given above is placed after this subfield SF8. In this case, charged particles formed during the light emission sustaining process Ic of the subfield SF8 gradually disappear over the course of time, with most of them disappearing during said preliminary period AU. Therefore, as shown in FIG. 22, the width of the surplus charge erasing pulses CP to be first supplied during the light emission sustaining process Ic of the first subfield SF1 is set to a relatively wide pulse width $T_{c1}$.

As described in detail above, according to the present invention, the width of the first sustaining pulses to be first supplied during each light emission sustaining process, which is performed during the display period of one field, is set wider than the width of the sustaining pulses to be supplied during the subsequent light emission sustaining processes. In addition, the width of the above-mentioned first sustaining pulses is set narrower in accordance with the frequency of the light emission sustaining discharges occurring immediately before said process.

Therefore, according to the present invention, it becomes possible to display an image of higher quality with many tone stages, by increasing the number of the subfields corresponding to the shortened time of period because the time required for each light emission sustaining process can be decreased without causing the discharge cells to discharge erroneously.

This application is based on Japanese Patent Application No. 2000-154867 which is hereby incorporated by reference.

What is claimed is:

1. A method for driving a plasma display panel in which each discharge cell formed at each intersection of a plurality of row electrodes corresponding to a display lines and a plurality of column electrodes intersecting with said row electrodes is driven in accordance with a video signal, comprising:

dividing a display period of one field of said video signal into a plurality of subfields, supplying scanning pulses, in a picture element data write process, to each of said row electrodes sequentially, which generate selective discharge for setting each of said discharge cells to a light emission cell state or non-light emission cell state in accordance with the picture element data corresponding to said video signal; and supplying sustaining pulses, in a light emission sustaining process, which generate sustaining discharge only in said discharge cells in said light emission cell state, to each of said row electrodes, at a frequency corresponding to the weight of each of said subfields;

wherein the width of a first sustaining pulse of said sustaining pulses to be supplied first during said light emission sustaining process in each of said subfields is set wider than that of the subsequent sustaining pulses in said subfield, and the width of said first sustaining pulse in each of said subfields, except for a first subfield, is narrowed in accordance with the increasing frequency of said sustaining discharges occurring in a subfield immediately before the supply of said first sustaining pulse during the display period of one field in each subfield.

2. A method for driving the plasma display panel according to claim 1, wherein said selective discharge takes place only during said picture element data write process in one of said subfields during the display period of one field.

3. A method for driving the plasma display panel according to claim 1, wherein intermediate brightness having (N+1) tones is displayed by generating said sustaining discharge only during said light emission sustaining process in each of N successive subfields from the start of the display period of one field.

4. A method for driving the plasma display panel according to claim 1, wherein surplus charge erasing pulses are supplied to each of said row electrodes, which generate an erasing discharge for erasing any surplus charge immediately before each of said first sustaining pulses to be supplied during said light emission sustaining process for said subfields.

5. A method for driving the plasma display panel according to claim 4, wherein the width of said surplus charge erasing pulses are narrowed in accordance with the frequency of said sustaining discharges occurring during a period immediately before the supply of said surplus charge erasing pulses during said display period of one field.

6. The method for driving a plasma display panel according to claim 1, wherein a width of a first sustaining pulse to be supplied first in a second subfield is narrower than a width of a first sustaining pulse to be supplied in any other subfield.

7. A method for driving a plasma display panel in which each discharge cell formed at each intersection of a plurality of row electrodes corresponding to display lines and a plurality of column electrodes intersecting with said row electrodes is driven in accordance with a video signal, comprising:

dividing a display period of one field of said video signal into a plurality of subfields, supplying scanning pulses, in a picture element data write process, to each of said row electrodes sequentially, which generate selective discharge for setting each of said discharge cells to a light emission cell state or non-light emission cell state in accordance with the picture element data corresponding to said video signal; and supplying sustaining pulses, in a light emission sustaining process, which generate sustaining discharge only in said discharge cells in said light emission cell state, to each of said row electrodes, by a frequency corresponding to the weight of each of said subfields;

wherein the width of the first one of said sustaining pulses to be supplied during said light emission sustaining process in each of said subfields is set wider than that of the subsequent sustaining pulses in said subfield, and the width of said first sustaining pulse in each subfield, except for a first subfield, is narrowed in accordance with the increasing frequency of said sustaining pulses to be supplied during said light emission sustaining process in a subfield immediately prior to each subfield.

* * * * *